US012359862B2

(12) United States Patent
Fei et al.

(10) Patent No.: US 12,359,862 B2
(45) Date of Patent: Jul. 15, 2025

(54) REFRIGERATION MODULE AND REFRIGERATOR

(71) Applicants: QINGDAO HAIER REFRIGERATOR CO., LTD., Shandong (CN); HAIER SMART HOME CO., LTD., Shandong (CN)

(72) Inventors: Bin Fei, Qingdao (CN); Zhanzhan Liu, Qingdao (CN); Xiaobing Zhu, Qingdao (CN); Peng Li, Qingdao (CN); Changzhi Wang, Qingdao (CN)

(73) Assignees: QINGDAO HAIER REFRIGERATOR CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 315 days.

(21) Appl. No.: 17/789,745

(22) PCT Filed: Sep. 1, 2020

(86) PCT No.: PCT/CN2020/112853
§ 371 (c)(1),
(2) Date: Jun. 28, 2022

(87) PCT Pub. No.: WO2021/139185
PCT Pub. Date: Jul. 15, 2021

(65) Prior Publication Data

US 2023/0030291 A1 Feb. 2, 2023

(30) Foreign Application Priority Data

Jan. 6, 2020 (CN) ..... 202010011102.9

(51) Int. Cl.
*F25D 11/02* (2006.01)
*F25D 15/00* (2006.01)
(Continued)

(52) U.S. Cl.
CPC ..... *F25D 11/02* (2013.01); *F25D 15/00* (2013.01); *F25D 19/02* (2013.01); *F25D 23/003* (2013.01)

(58) Field of Classification Search
CPC ..... F25D 11/02; F25D 15/00; F25D 23/003; F25D 19/00; F25D 19/02
See application file for complete search history.

(56) References Cited

U.S. PATENT DOCUMENTS 3,675,439 A 7/1972 Maurer
4,048,813 A * 9/1977 Falk ..... F25D 3/105 62/297
(Continued)

FOREIGN PATENT DOCUMENTS

CN 103216987 A 7/2013
CN 103471314 A 12/2013
(Continued)

OTHER PUBLICATIONS

International Search Report and Written Opinion for PCT/CN2020/112853 (ISA/CN) mailed Nov. 25, 2020 (8 pages).
(Continued)

*Primary Examiner* — Filip Zec
(74) *Attorney, Agent, or Firm* — troutman pepper locke; Tim Tingkang Xia, Esq.

(57) ABSTRACT

A refrigeration module, comprising: a module body, in which an installation space is defined; and a refrigeration system disposed in the installation space for use in generating cold, wherein a cold supply port is provided on the module body, the cold supply port is configured to be detachably connected to an external pipeline, and the cold generated by the refrigeration system is supplied to the external pipeline by the cold supply port. Further provided by the present invention is a refrigerator that has the refrigeration module. By means of separating the refrigeration
(Continued)

module and a storage portion, the storage portion does not need to give way to the refrigeration system, and the internal volume of the refrigerator may be greatly increased; and the refrigeration module may be freely matched with one or more of the same or different storage portions as needed.

6 Claims, 10 Drawing Sheets

(51) Int. Cl.
*F25D 19/02* (2006.01)
*F25D 23/00* (2006.01)

(56) References Cited

U.S. PATENT DOCUMENTS 5,417,079 A * 5/1995 Rudick ..... A47F 3/0408 62/448
6,550,255 B2 * 4/2003 Rudick ..... F28D 15/0266 62/6
7,231,782 B2 * 6/2007 Jung ..... F25D 23/006 62/298
7,448,225 B2 * 11/2008 Iguchi ..... F25D 19/02 62/298
7,703,293 B2 * 4/2010 An ..... F25D 17/065 62/186
7,950,248 B2 * 5/2011 Cho ..... F25D 23/003 62/446
8,424,332 B2 4/2013 Yamasaki
9,532,660 B2 * 1/2017 Jafa ..... A47F 3/0404
9,741,196 B2 * 8/2017 Yamagami ..... G07F 11/08
10,935,300 B2 * 3/2021 Takase ..... F25D 23/006
11,512,887 B2 * 11/2022 Jeon ..... F25D 17/062
11,680,742 B2 * 6/2023 Baik ..... F25D 11/02 62/408
2004/0261444 A1 * 12/2004 Chastine ..... F25D 17/065 62/408
2006/0130518 A1 * 6/2006 Kang ..... F25D 11/022 62/526
2016/0153694 A1 * 6/2016 Ko ..... F25D 17/065 62/186
2016/0298891 A1 * 10/2016 Grewal ..... F25C 5/22
2018/0106414 A1 4/2018 Reid
2020/0256610 A1 * 8/2020 Baik ..... F25D 17/065

FOREIGN PATENT DOCUMENTS

CN 105737420 A 7/2016
CN 107560291 A 1/2018
CN 107664372 A 2/2018
CN 208688065 U 4/2019
CN 208817811 U 5/2019
CN 110375491 A 10/2019
CN 212378339 U 1/2021
JP S49-6563 U 1/1974
JP S51-47499 U 4/1976
JP S54-079862 A 6/1979
JP 2006162148 A 6/2006
JP 2006-194489 A 7/2006

OTHER PUBLICATIONS

Search Report for EP Application No. 20911702.7 dated Nov. 23, 2022 (4 pages).
1st Office Action for EP Application No. 20911702.7 dated Dec. 5, 2022 (5 pages).
2nd Office Action for EP Application No. 20911702.7 dated Mar. 29, 2023 (5 pages3.
3rd Office Action for EP Patent Application No. 20911702.7 dated Jul. 13, 2023 (5 pages).
1st Office Action for China Patent Application No. 202010011102.9, dated Apr. 17, 2024 (24 pages).

* cited by examiner

REFRIGERATION MODULE AND REFRIGERATOR

CROSS-REFERENCE TO RELATED APPLICATIONS

The present application is a national phase entry of International Application No. PCT/CN2020/112853, filed Sep. 1, 2020, which claims priority to Chinese Patent Application No. 202010011102.9, filed Jan. 6, 2020, which are each incorporated herein by reference in their entirety.

FIELD OF THE INVENTION

The present invention relates to the technical field of refrigerating and freezing devices, and particularly relates to a refrigeration module and a refrigerator.

BACKGROUND OF THE INVENTION

A traditional free-standing refrigerator integrates a refrigeration system and iii a cabinet. Generally, the refrigeration system needs to occupy space of a large volume, which causes that the internal volume of the cabinet is limited, and the cabinet usually needs to make room for the refrigeration system, which results in that the local shape of the cabinet is special and the process is complicated. In addition, due to the fixed size of the free-standing refrigerator, the position for is placing the refrigerator is relatively single, which cannot meet the user's need to adjust the position of the refrigerator.

BRIEF DESCRIPTION OF THE INVENTION

One purpose of the present invention is to provide a refrigeration module capable of independently providing cooling capacity.

A further purpose of the present invention is to improve the refrigeration efficiency of the refrigeration module.

Another further purpose of the present invention is to provide a refrigerator in which storage portions can be disposed as desired.

Specially, the present invention provides a refrigeration module, including:

a module body defining a mounting space; and a refrigeration system, disposed in the mounting space and used for generating cooling capacity; where a cold supply port is disposed in the module body, the cold supply port is configured to be detachably connected to an external pipeline, and cooling capacity generated by the refrigeration system is supplied into the external pipeline by the cold supply port.

Alternatively, the refrigeration system is a compression refrigeration system having a compressor, a condenser, and an evaporator.

The module body includes:

an evaporator compartment in which the evaporator is disposed; and a compressor compartment, disposed separately from the evaporator compartment, the compressor and the condenser being disposed in the compressor compartment.

Alternatively, the evaporator compartment includes a box body and a cover plate;

the box body has a bottom wall and side walls, and the box body defines an upward opening;

the cover plate is located above the box body, and used for closing the opening, and a containing cavity of the evaporator is defined between the cover plate and the box body;

the cold supply port is formed in the rear end of the cover plate in an up-down direction.

Alternatively, an air return port is formed in the front end of the cover plate in the up-down direction, the air return port is configured to be detachably connected to an external pipeline, and external air flows into the containing cavity via the air return port.

Alternatively, an electrical connection port is further formed in the rear end of the cover plate in the up-down direction, the electrical connection port is configured to be detachably connected to an external pipeline having a power supply line, and the power supply line is introduced into the refrigeration module via the electrical connection port; the electrical connection port is formed in the lateral portion of the cold supply port in a transverse direction.

Alternatively, the evaporator includes a plurality of fins disposed in parallel and a coil pipe penetrating through the fins, an airflow channel is defined between adjacent fins, and the evaporator is transversely placed in the evaporator compartment so that the airflow channel extends in a front-rear direction.

Alternatively, the refrigeration system also has a centrifugal fan, which is disposed in the evaporator compartment, located behind the evaporator, and used for promoting flowing of cold air to the cold supply port, and a volute of the centrifugal fan is placed to be inclined upwards from front to rear.

Alternatively, the refrigeration system further has a heat dissipation fan; the compressor compartment is located behind the evaporator compartment, the bottom of the compressor compartment has a supporting plate, and the supporting plate includes a first section and a second section extending forwards from the front end of the first section.

The compressor, the heat dissipation fan and the condenser are successively disposed on the first section in a transverse direction, and a bottom air inlet and a bottom air outlet are formed in the second section at an interval in the transverse direction, wherein the condenser is close to the bottom air inlet, and the compressor is close to the bottom air outlet; the heat dissipation fan is configured to promote that ambient air around the bottom air inlet enters the compressor compartment from the bottom air inlet, and sequentially passes through the condenser and the compressor, and then flows from the bottom air outlet to an external environment so as to dissipate heat from the compressor and the condenser.

The present invention provides a refrigerator, which includes:

one or more storage portions, a corresponding storage space being defined in each storage portion; and the above-mentioned refrigeration module; wherein the one or more storage portions and the refrigeration module are disposed separately, and the cooling capacity flows out of the refrigeration module from the cold supply port and then flows into the storage portion via a pipeline.

Alternatively, at least a part of the pipeline is a vacuum pipe.

The vacuum pipe includes an outer pipe, an inner pipe and an end sealing connection piece, wherein the outer pipe is disposed outside the inner pipe in a sleeving mode and is arranged at an interval from the inner pipe; the end sealing connection piece is configured to be sandwiched between the outer pipe and the inner pipe to seal and fix the outer pipe and the inner pipe, and a vacuum cavity is defined among the outer pipe, the inner pipe and the end sealing connection piece; the outer pipe is made of a metal pipe fitting; the inner pipe is made of a metal pipe fitting; the end sealing connection piece is made of quartz glass.

The refrigeration module of the present invention has the module body in which the mounting space is defined; and the refrigeration system used for generating the cooling capacity is disposed in the mounting space; since the cold supply port is disposed in the module body, and the cold supply port is configured to be detachably connected to the external pipeline, the cooling capacity generated by the refrigeration system is supplied into the external pipeline by the cold supply port. The refrigeration module can be sold and used separately, and especially when it is used as a part of a split refrigerator, the using experience of a user can be improved.

Further, the refrigeration module of the present invention can enable air entering the refrigeration module to exchange heat sufficiently by forming the cold supply port in the rear end of the cover plate in the up-down direction, and forming the air return port in the front end of the cover plate in the up-down direction, which improves the heat exchange efficiency of the evaporator, and improves the heat exchange efficiency of the whole refrigeration module.

The above and other objectives, advantages, and characteristics of the present invention will be better understood by those skilled in the art according to the following detailed description of specific embodiments of the present invention in conjunction with the accompanying drawings.

BRIEF DESCRIPTION OF THE DRAWINGS

In the following part, some specific embodiments of the present invention will be described in detail in an exemplary rather than limited manner with reference to the accompanying drawings. The same reference numerals in the accompanying drawings indicate the same or similar components or parts. Those skilled in the art should understand that these accompanying drawings are not necessarily drawn to scale. In the accompanying drawings.

DETAILED DESCRIPTION

In the following description, the orientations or positional relationships indicated by "front", "rear", "upper", "lower", "left", "right", etc. are orientations based on a refrigerator 200 itself as a reference.

Figure 1:
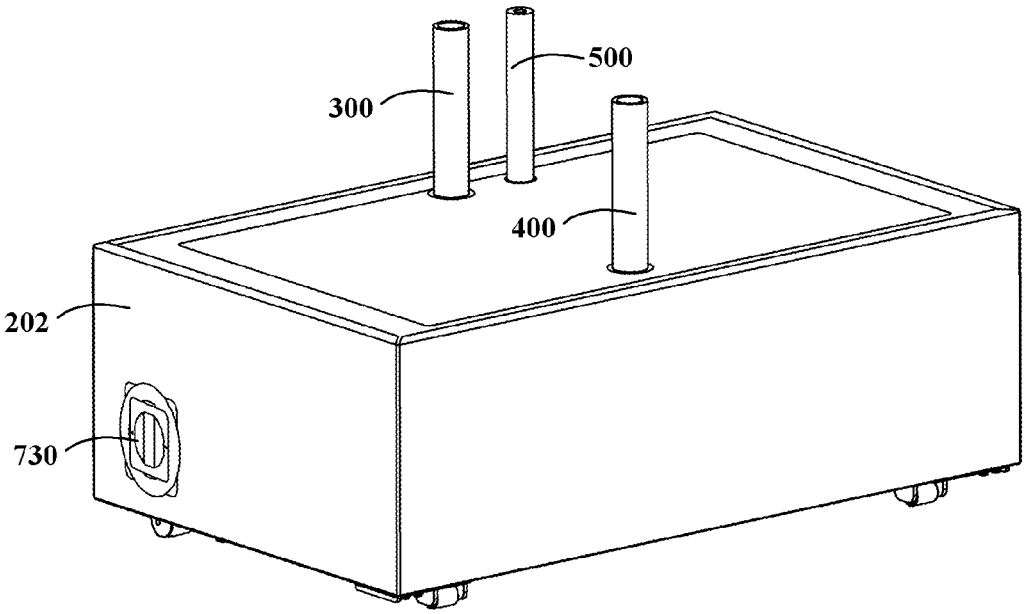
FIG. 1 is a structural schematic view of a refrigeration module and an external pipeline according to one embodiment of the present invention.
Figure 2:
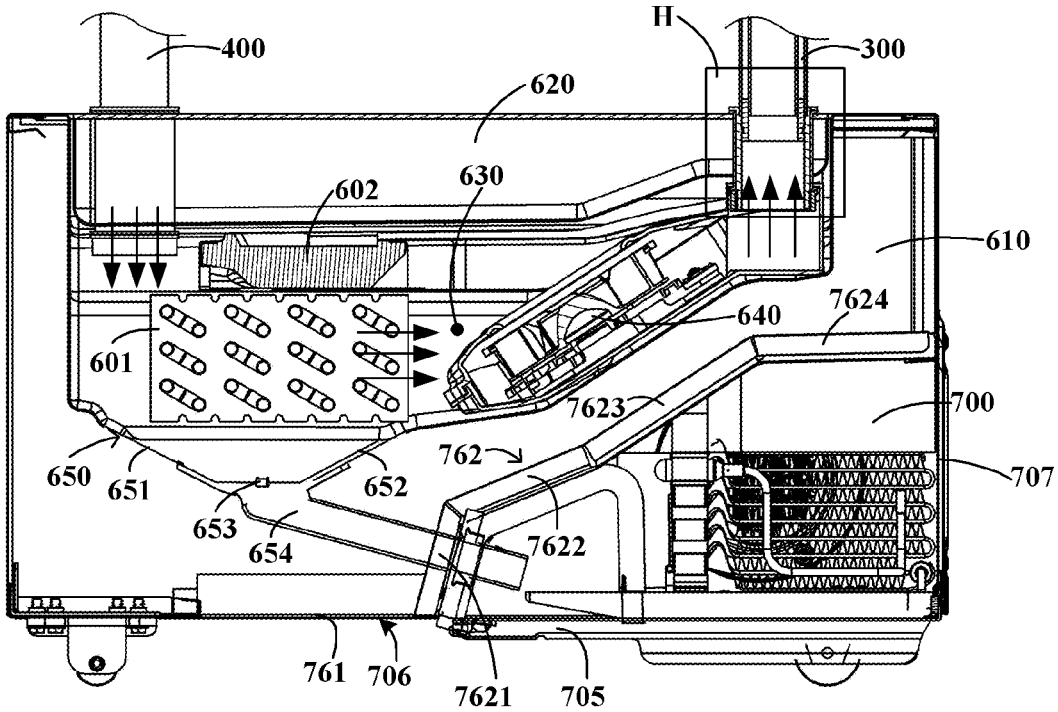
FIG. 2 is a schematic cross-sectional view of the refrigeration module and the external pipeline shown in FIG. 1.

FIG. 1 is a structural schematic view of a refrigeration module 202 and an external pipeline according to one embodiment of the present invention. FIG. 2 is a schematic cross-sectional view of FIG. 1, and is also a partially enlarged view of a part G in FIG. 9. The refrigeration module 202 of the embodiment of the present invention includes a module body and a refrigeration system. A mounting space is defined in the module body. The refrigeration system is disposed in the mounting space and used for generating cooling capacity. A cold supply port is disposed in the module body, the cold supply port is configured to be detachably connected to an external pipeline 300, and cooling capacity generated by the refrigeration system is supplied into the external pipeline 300 by the cold supply port. The refrigeration module 202 of the present invention has the module body in which the mounting space is defined, and the refrigeration system for generating the cooling capacity is disposed in the mounting space. The cold supply port is disposed in the module body, and the cold supply port is configured to be detachably connected to the external pipeline, so that the cooling capacity generated by the refrigeration system is supplied into the external pipeline by the cold supply port. The refrigeration module 202 can be independently sold and used, and when it is used as a part of a split refrigerator 200, it can be connected to one or more storage portions 201 as needed so as to improve the using experience of a user.

In some embodiments, the refrigeration system is a compression refrigeration system having a compressor 701, a condenser 703, and an to evaporator 601. The module body includes an evaporator compartment 600 and a compressor compartment 700. An evaporator 601 is disposed in the evaporator compartment 600. The compressor compartment 700 is disposed separately from the evaporator compartment 600. A compressor 701 and a condenser 703 are disposed in the compressor compartment 700. The mounting space includes a space defined by the evaporator compartment 600 and a space defined by the compressor compartment 700. The refrigeration system of the refrigeration module 202 of the present invention employs the compression refrigeration system having the compressor 701, the condenser 703, and the evaporator 601, and the evaporator 601 is used for cooling air entering the evaporator compartment 600 to form cold air. In some embodiments, the compressor compartment 700 is located behind the evaporator compartment 600, and the refrigeration module 202 is made compact in structure by designing the module body to have the evaporator compartment 600 and the compressor compartment 700 disposed one behind the other.

Figure 5:
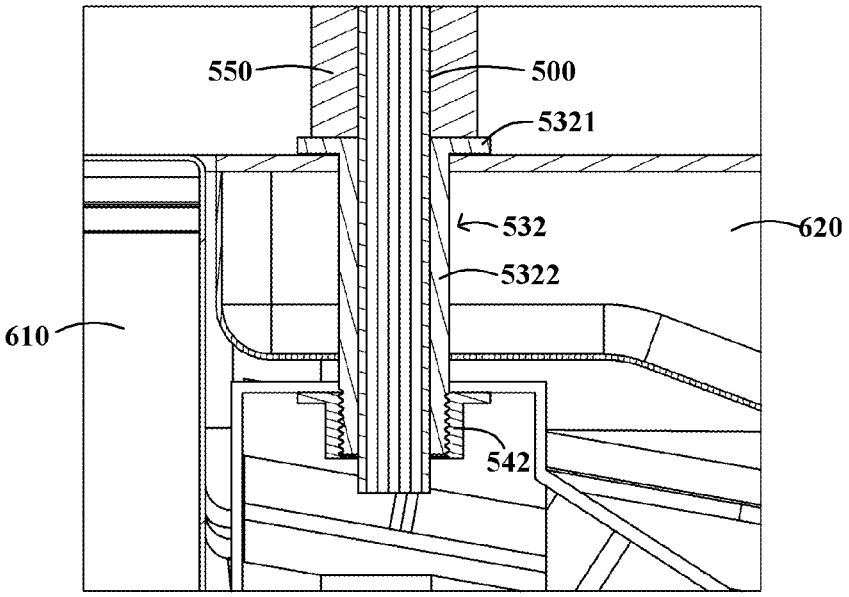
FIG. 5 is a partially schematic cross-sectional view of an electrical connection port part of the refrigeration module shown in FIG. 1.

As shown in FIG. 2, the evaporator compartment 600 includes a box body 610 and a cover plate 620; the box body 610 has a bottom wall and side walls, and the box body 610 defines an upward opening; the cover plate 620 is located above the box body 610 and used for closing the opening, and a containing cavity 630 of the evaporator 601 is defined between the cover plate 620 and the box body 610; the cold supply port is formed in the rear end of the cover plate 620 in an up-down direction. The box body 610 has an outer shell, an inner container and a foamed layer located between the outer shell and the inner container; the cover plate 620 has an outer shell, an inner container, and a foamed layer located between the outer shell and the inner container. The material of the outer shell, the inner container and the foamed layer of the box body 610 and the cover plate 620 can refer to that of an outer shell, an inner container and a foamed layer of a conventional refrigerator, for example, the outer shell and the inner container of the box body 610 and the cover plate 620 are made of a plastic material, and the foamed layer is a polyurethane foamed layer. The containing cavity 630 is defined between the inner container of the box body 610 and the inner container of the cover plate 620. Thermal insulation foam 602 may also be disposed between the top surface of the evaporator 601 and the inner container of the cover plate 620. The cover plate 620 of the evaporator compartment 600 of the present invention is disposed above the box body 610 and can be opened and closed, which can facilitate mounting the evaporator 601. The cold supply port is disposed in the rear end of the cover plate 620 so that the air entering the containing cavity 630 can be cooled by the evaporator 601 as much as possible. The cold supply port may be formed in a left-right direction, or may be formed in the up-down direction, or may be formed in the front-rear direction. It is preferable to dispose the cold supply port into a structure extending in the up-down direction, considering that when the refrigeration module 202 is in practical use, the external pipeline 300 in abutting joint with the cold supply port may be disposed to extend in the up-down direction, which can reduce the space required for the whole component in a horizontal direction, and is particularly suitable for an embedded cupboard. The cold supply port and the pipeline 300 may be in abutting joint either inside the evaporator compartment 600 or outside the evaporator compartment 600. That is, an abutting portion of the cold supply port for achieving abutting joint with the pipeline 300 may be an outer contour not exceeding the cover plate 620 or may be an outer contour exceeding the cover plate 620. As shown in FIG. 5, the cold supply port and the pipeline 300 are in abutting joint inside the evaporator compartment 600, so that the abutting portion of the cold supply port with the pipeline 300 can be subjected to thermal insulation by the cover plate 620.

In some embodiments, an air return port is formed in the front end of the cover plate 620 in the up-down direction, the air return port is configured to be detachably connected to an external pipeline 400, and external air flows into the containing cavity 630 through the air return port. The air return port is used for introducing the air into the containing cavity 630, and the air return port and the cold supply port are correspondingly disposed in the front and rear ends of the cover plate 620, so that the air can be cooled by the evaporator 601 as much as possible when flowing from the front side to the rear side of the evaporator 601; similarly, the air return port is disposed into a structure extending in the up-down direction so that the space required by the whole unit in the horizontal direction is reduced.

In some embodiments, an electrical connection port is further formed in the rear end of the cover plate 620 in the up-down direction, the electrical connection port is configured to be detachably connected to an external pipeline 500 having a power supply line, and the power supply line is introduced into the refrigeration module 202 via the electrical connection port; the electrical connection port is formed in the lateral portion of the cold supply port in a transverse direction. Similarly, the electrical connection port is disposed into a structure extending in the up-down direction, so that the space required by the whole unit in the horizontal direction can be reduced. The electric connection port is formed in the lateral portion of the cold supply port in the transverse direction, considering that water vapor nearby the cold supply port is little, it is possible to avoid excessive contact of the power supply line with the water vapor and improve the power distribution safety; at the same time, the compressor compartment 700 is disposed behind the evaporator compartment 600, and the electrical connection port is disposed in the rear end of the cover plate 620, so that the power supply line can be conveniently introduced into the compressor compartment 700, which can shorten the total length of the power supply line, and save costs.

The evaporator 601 includes a plurality of fins disposed in parallel and a coil pipe penetrating through the fins, an airflow channel is defined between adjacent fins, and the evaporator 601 is transversely disposed inside the evaporator compartment 600 such that the airflow channel extends in the front-rear direction. The airflow channel extends in the front-rear direction, so that the airflow of the air entering the containing cavity 630 flows more smoothly, and the heat exchange efficiency of the evaporator 601 is improved. The flowing direction of the airflow in the refrigeration module 202 is shown by an arrow in FIG. 2. The refrigeration system further has a centrifugal fan 640 which is disposed in the evaporator compartment 600, located behind the evaporator 601 and used for promoting flowing of cold air to the cold supply port, and a volute of the centrifugal fan 640 is placed to be inclined upwards from front to rear. That is, the front end of the centrifugal fan 640 is lower than the rear end so that the centrifugal fan 640 is in a backwards inclined posture as a whole. Thus, the height of the arrangement of the centrifugal fan 640 is reduced, and the height space occupied by the centrifugal fan 640 is reduced, thereby reducing the height space occupied by the evaporator compartment 600, that is to say, the height space occupied by the entire refrigeration module 202 is reduced. The centrifugal fan 640 may also be replaced with a cross-flow fan, or an axial flow fan. A water receiving tray 650 is formed in the bottom wall of the evaporator compartment 600 below the evaporator 601 and used for receiving defrosting water generated by the evaporator 601. The water receiving tray 650 preferably has a first inclined section 651 and a second inclined section 652, and a drain port 653 is formed at a lower portion of an intersection of the first inclined section 651 and the second inclined section 652. By disposing the water receiving tray 650 to have the first inclined section 651 and the second inclined section 652, the defrosting water can flow to the drain port 653 in time, which avoids stagnation in the evaporator compartment 600. An evaporating dish 704 is further disposed in the compressor compartment 700; the refrigeration module 202 further includes a drain pipe 654, one end of the drain pipe 654 is connected to the drain port 653, and the other end of the drain pipe 654 is communicated to the evaporating dish 704 so as to transfer the defrosting water in the water receiving tray 650 to the evaporating dish 704. The defrosting water may be discharged directly out of the refrigeration module 202, and is preferably introduced into the evaporating dish 704. The evaporating dish 704 may be located below the condenser 703 to evaporate water in the evaporating dish 704 by using heat of the condenser 703.

Figure 3:
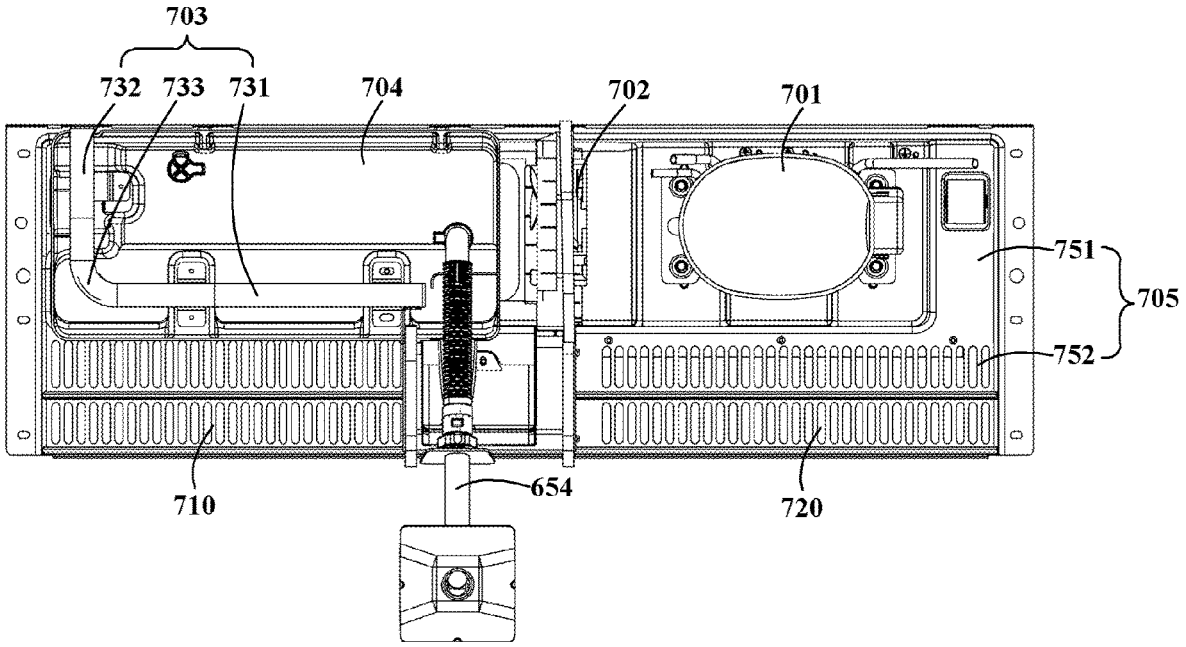
FIG. 3 is a schematic top view of a part of components of a compressor compartment of the refrigeration module shown in FIG. 1.

FIG. 3 is a schematic top view of a part of components of the compressor compartment 700 of the refrigeration module 202 shown in FIG. 1. The refrigeration system further has a heat dissipation fan 702; the bottom of the compressor compartment 700 has a supporting plate 705, the supporting plate 705 includes a first section 751 and a second section 752 extending forwards from the front end of the first section 751, the compressor 701, the heat dissipation fan 702 and the condenser 703 are sequentially disposed on the first section 751 at intervals in a transverse direction, and a bottom air inlet 710 and a bottom air outlet 720 are formed in the second section 752 at an interval in the transverse direction; wherein the condenser 703 is close to the bottom air inlet 710, and the compressor 701 is close to the bottom air outlet 720; the heat dissipation fan 702 is configured to promote that ambient air around the bottom air inlet 710 enters the compressor compartment 700 from the bottom air inlet 710 and passes through the condenser 703 and the compressor 701 in sequence, and then flows to the external environment from the bottom air outlet 720 to dissipate heat of the compressor 701 and the condenser 703. The bottom air inlet 710 close to the condenser 703 and the bottom air outlet 720 close to the compressor 701 are defined in the bottom wall of the compressor compartment 700, circulation of heat dissipation airflow is completed at the bottom of the refrigeration module 202, the space between the refrigeration module 202 and a support surface is fully used, the space occupied by the refrigeration module 202 is reduced, and at the same time, good heat dissipation of the compressor compartment 700 is ensured, which fundamentally solves the problem that when the refrigeration module 202 is used as a component of the embedded refrigerator 200, a balance between heat dissipation and space occupation of the compressor compartment 700 cannot be achieved, and has particularly important significance. The four corners of the bottom wall of the refrigeration module 202 can also be is provided with support rollers, the refrigeration module 202 is placed on the support surface via the support rollers, and a certain space is formed between the bottom wall of the refrigeration module 202 and the support surface.

The refrigeration module 202 further includes: a special-shaped plate 706 having a bottom horizontal section 761 located at the bottom front side of the refrigeration module 202; the front end of the second section 752 is connected with the bottom horizontal section 761 such that the supporting plate 705 and the bottom horizontal section 761 jointly form the bottom wall of the refrigeration module 202. The special-shaped plate 706 also has a bent section 762 bent and extending upwards and backwards from the rear end of the bottom horizontal section 761; the bent section 762 extends to a position above the supporting plate 705, and forms the top of the compressor compartment 700. The supporting plate 705 and the special-shaped plate 706 are disposed so that the supporting plate 705 and the bottom horizontal section 761 jointly constitute the bottom wall of the refrigeration module 202, and the bottom air inlet 710 and the bottom air outlet 720 are disposed in the front end portion of the supporting plate 705; the bottom air inlet 710 and the bottom air outlet 720 can be respectively formed by a plurality of ventilation holes so as to prevent the refrigeration module 202 against rats; at the same time, this structure can greatly simplify the mounting process of the refrigeration module 202, and only the compressor 701, the heat dissipation fan 702, the condenser 703, etc. need to be integrated on the supporting plate 705, and then the supporting plate 705 and the special-shaped plate 706 are integrated, namely, mounting of the bottom wall of the refrigeration module 202 is completed. The bent section 762 includes a first inclined section 7621, a second inclined section 7622, a third inclined section 7623 and a top horizontal section 7624, wherein the first inclined section 7621 extends upwards from the rear end of the bottom horizontal section 761, the second inclined section 7622 extends backwards and upwards from the upper end of the first inclined section 7621, the third inclined section 7623 extends backwards and upwards from the upper end of the second inclined section 7622, and the top horizontal section 7624 extends backwards from the upper end of the third inclined section 7623 to cover a position above the first section 751 of the supporting plate 705. The slope structure of the bent section 762 can guide and rectify air inflow airflow, so that the airflow entering from the bottom air inlet 710 flows to the condenser 703 in a more concentrated mode, which avoids that the airflow is too dispersed and cannot pass through the condenser 703 more, thereby further ensuring the heat dissipation effect of the condenser 703; at the same time, the slope structure of the bent section 762 guides the air outflow airflow of the bottom air outlet 720 to the front side of the bottom air outlet 720, so that the air outflow airflow flows more smoothly out of the compressor compartment 700, thereby further improving the circulating smoothness of the airflow. In addition, side ventilation holes 730 are formed in both side plates of the compressor compartment 700 in the transverse direction to increase a heat dissipation path to ensure the heat dissipation effect of the compressor compartment 700. The side ventilation holes 730 may be covered with a ventilation cover plate which forms small grid-type ventilation holes.

As shown in FIG. 3, the condenser 703 includes a first straight section 731 extending in the transverse direction, a second straight section 732 extending front and back, and a transitional curved section 733 connecting the first straight section 731 and the second straight section 732, thereby forming an L-shaped condenser having an appropriate heat exchange area. A plate section of the rear wall (namely, a back plate 707) of the compressor compartment 700 corresponding to the condenser 703 is namely a plate section of the back plate 707 facing the first straight section 731. An ambient airflow entering via the side air vent 730 directly exchanges the heat with the second straight section 732, and the ambient air entering via the bottom air inlet 710 directly exchanges the heat with the first straight section 731. As such, more ambient air entering the compressor compartment 700 is further concentrated at the condenser 703 to ensure the overall cooling uniformity of the condenser 703. In combination with FIG. 2 and FIG. 3, the portion of the back plate 707 of the compressor compartment 700 facing the condenser 703 may be a continuous plate surface.

The plate section of the rear wall (namely, the back plate 707) of the compressor compartment 700 corresponding to the condenser 703 is designed into a continuous plate surface, and heat dissipation airflow entering the compressor compartment 700 is closed at the condenser 703, so that the ambient air entering from the bottom air inlet 710 is more concentrated at the condenser 703, which ensures the heat exchange uniformity of each condensation section of the condenser 703, facilitates forming a better heat dissipation airflow path, and also achieves a better heat dissipation effect. Moreover, the plate section of the back plate 707 facing the condenser 703 is the continuous plate surface and is not provided with the air inlet, so that the problems that in the conventional design, air outlet and air inlet are both concentrated at the rear part of the compressor compartment 700, which causes that the hot air blown from the compressor compartment 700 is not cooled by the ambient air in time and enters the compressor compartment 700 again, causing adverse effects on heat exchange of the condenser 703 are avoided, and thus the heat exchange efficiency of the condenser 703 is guaranteed.

Figure 4:
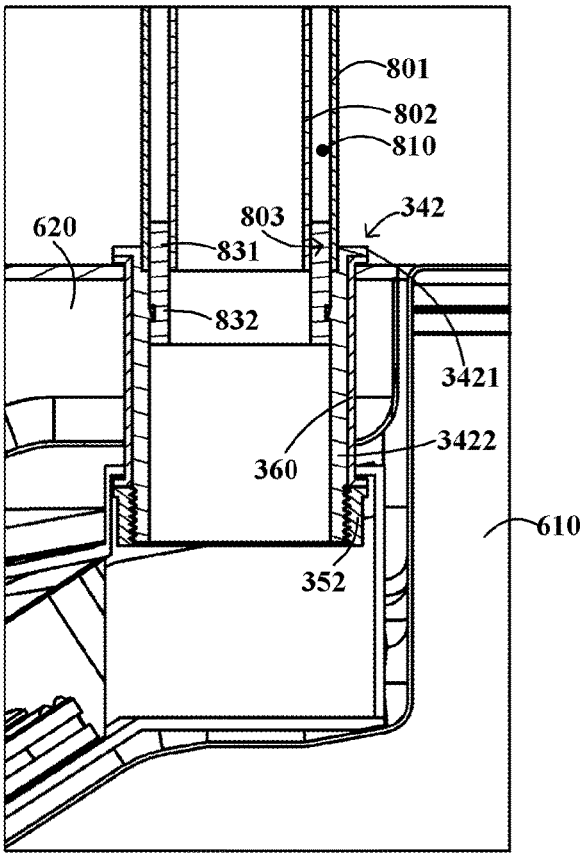
FIG. 4 is a partially schematic cross-sectional view of a cold supply port part of the refrigeration module shown in FIG. 1.

FIG. 4 is a partially schematic cross-sectional view of a cold supply port part of the refrigeration module 202 shown in FIG. 1, and is also a partially enlarged view of a part H in FIG. 2. FIG. 5 is a partially schematic cross-sectional view of an electrical connection port part of the refrigeration module 202 shown in FIG. 1, and is also a partially enlarged view of a part E in FIG. 8. At the cold supply port, the inner side of the cover plate 620 is provided with a fixing piece 352 with an inner wall having a threaded structure; a corresponding threaded structure is formed on the outer side of the tail end of the air supply pipeline 300, and detachable connection between the air supply pipeline 300 and the cold supply port is realized by means of threaded connection. Likewise, at the air return port, the inner side of the cover plate 620 is provided with a fixing piece with an inner wall having a threaded structure; a corresponding threaded structure is formed on the outer side of the tail end of the air return pipeline 400, and detachable connection between the air return pipeline 400 and the air return port is realized by means of threaded connection. At the electrical connection port, the inner side of the cover plate 620 is provided with a fixing piece 542 with an inner wall having a threaded structure; a corresponding threaded structure is formed on the outer side of the tail end of the threading pipeline 500, and detachable connection between the threading pipeline 500 and the electrical connection port is realized by means of threaded connection. The external pipeline and the refrigeration module 202 can be conveniently mounted and disassembled by disposing the fixing pieces having the threaded structures at the cold supply port, the air return port and the electrical connection port. Taking FIG. 5 as an example, a threading joint 532 is disposed outside the threading pipeline 500 near the refrigeration module 202, and the threading joint 532 passes through the electrical connection port of the cover plate 620. The fixing piece 542 at the electrical connection port in threaded connection fit with the threading joint 532 within the evaporator compartment 600 to fix the threading pipeline 500 to the refrigeration module is 202. The threading pipeline 500 is fixed to the refrigeration module 202 by matching the threading joint 532 with the fixing piece 542, so that the structure is ingenious, mounting is easy and stability is good. Specifically, the threading joint 532 has a joint base 5321 and a joint protrusion 5322, the inner side surface of the joint base 5321 is attached to the outer side surface of the cover plate 620, the end of the joint protrusion 5322 goes beyond the cover plate 620 and the outer side surface of the portion going beyond is provided with a threaded structure corresponding to the threaded structure of the fixing piece 542. The threading pipeline 500 and the threading joint 532 may be integrally injection-molded to reduce assembly steps and improve assembly efficiency. The threading joint 532 may be made of a PVC material. The fixing piece 542 may be made of an ABS or PS material. The exterior of the threading pipeline 500 may also be wrapped with a thermal insulation pipe 550. The thermal insulation pipe 550 may be an EPU pipe or an EPE pipe.

Figure 6:
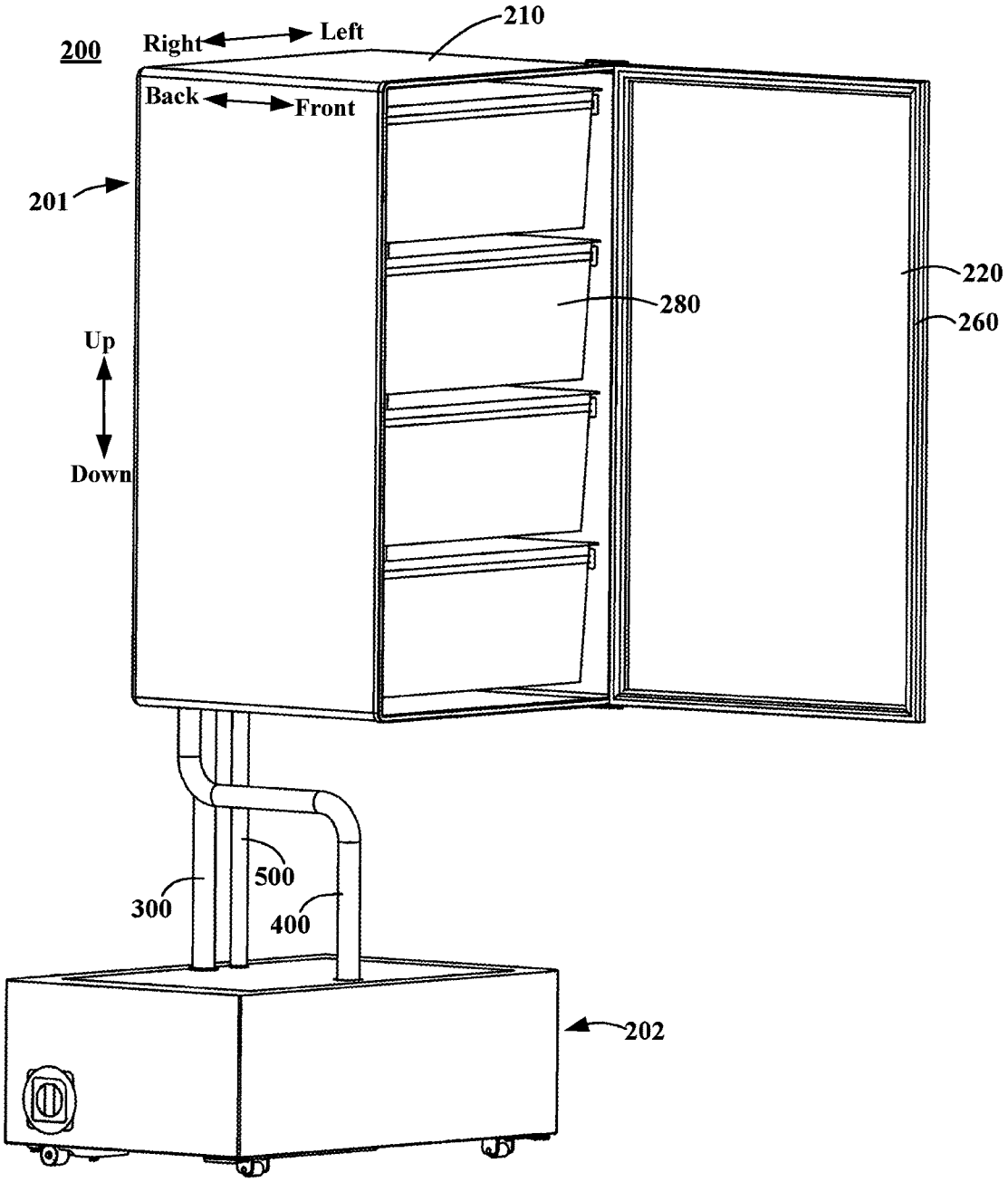
FIG. 6 is a structural schematic view of a refrigerator employing the refrigeration module shown in FIG. 1.
Figure 7:
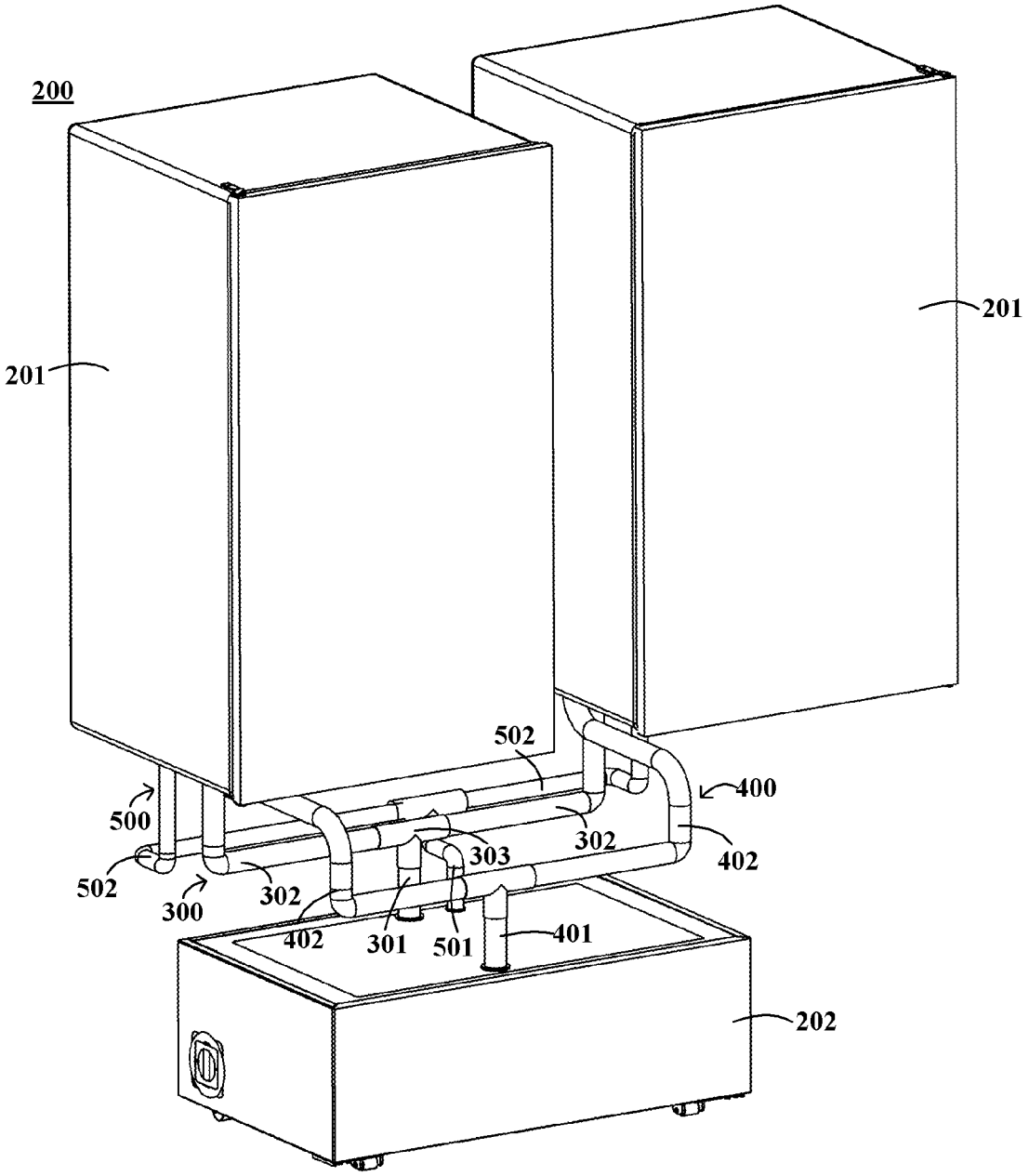
FIG. 7 is another structural schematic view of the refrigerator employing the refrigeration module shown in FIG. 1.
Figure 8:
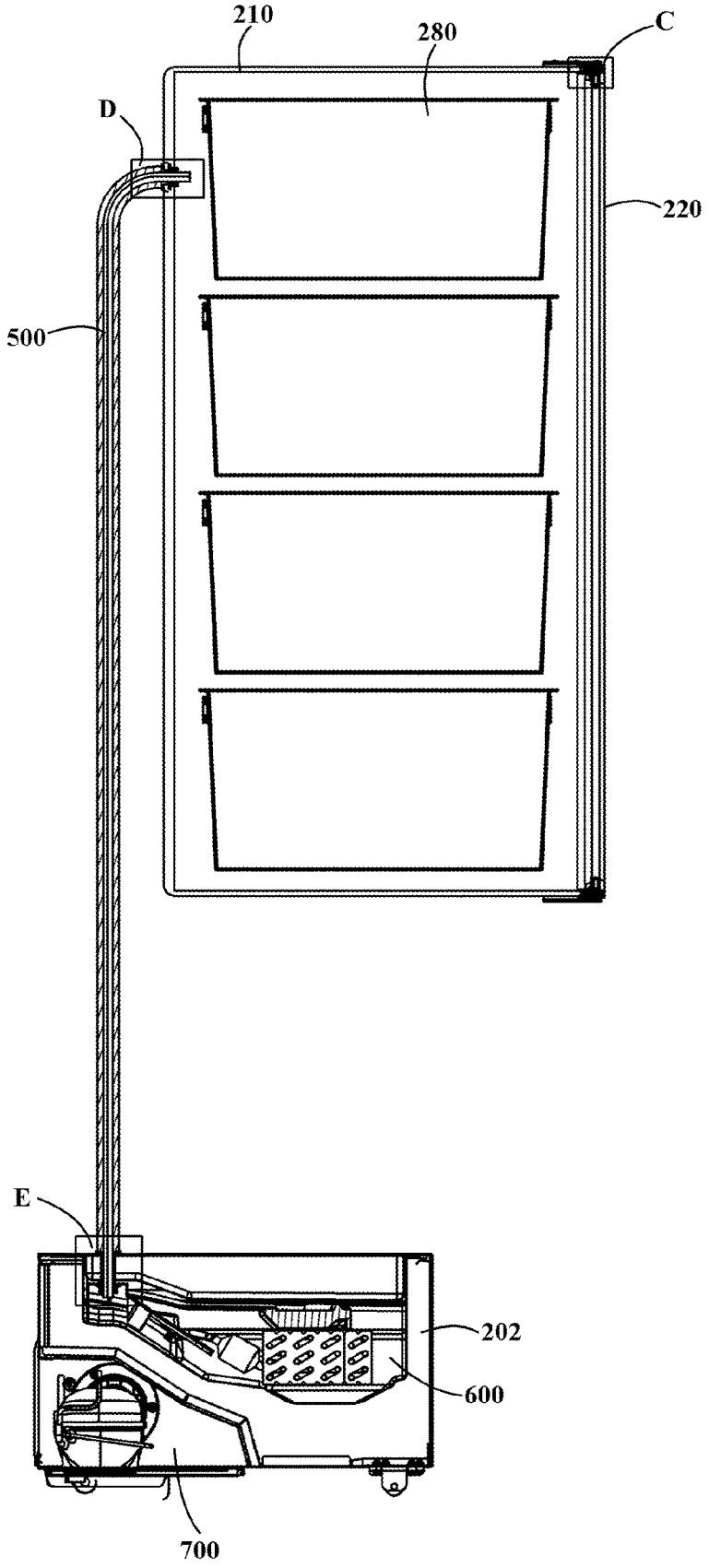
FIG. 8 is a schematic cross-sectional view of the refrigerator shown in FIG. 6.
Figure 9:
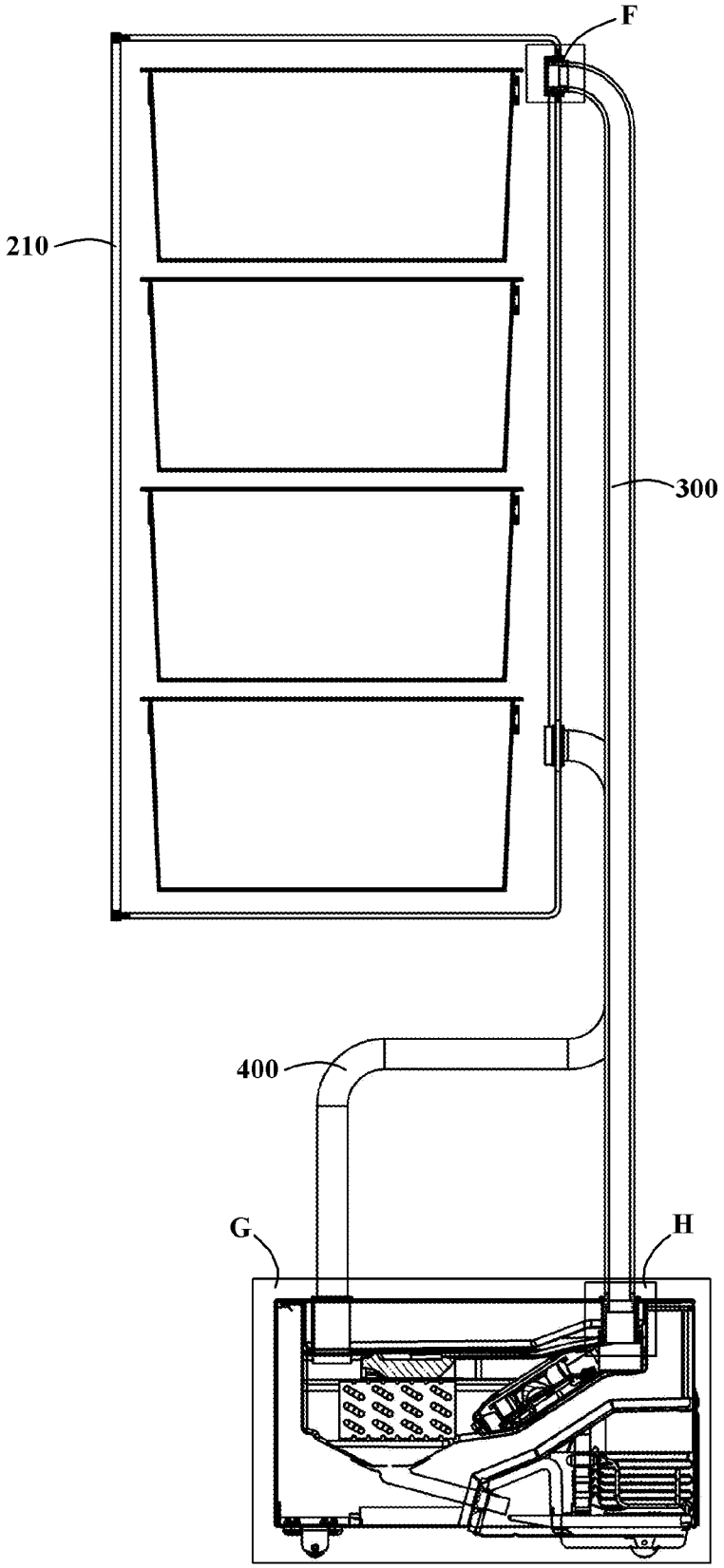
FIG. 9 is another schematic cross-sectional view of the refrigerator shown in FIG. 6.

FIG. 6 is a structural schematic view of a refrigerator 200 using the refrigeration module 202 shown in FIG. 1. FIG. 7 is another structural schematic view of a refrigerator 200 using the refrigeration module 202 shown in FIG. 1. FIG. 8 is a schematic cross-sectional view of the refrigerator 200 shown in FIG. 6. FIG. 9 is another schematic cross-sectional view of the refrigerator 200 shown in FIG. 6. The present invention further provides a refrigerator 200 including: one or more storage portions 201 and a refrigeration module 202. A corresponding storage space is defined in each storage portion 201. The one or more storage portions 201 and the refrigeration module 202 are disposed separately, and the cooling capacity flows out of the refrigeration module 202 from the cold supply port and then flows into the storage portion 201 via the pipeline 300. By disposing the refrigeration module 202 and the storage portion 201 separately for the refrigerator 200, the storage portion 201 does not need to give way for the refrigeration system, which can greatly increase the internal volume of the refrigerator 200; the refrigeration module 202 is independently disposed, can be free to match with one or more same or different storage portions 201 as needed, and is particularly suitable for an embedded refrigerator, so that the utilization rate of space can be greatly improved and the user experience can be improved. For example, the refrigerator 200 shown in FIG. 6 includes one storage portion 201; the refrigerator 200 shown in FIG. 7 includes two storage portions 201. The number of the storage portions 201 may also be two or more, for example, three, four, etc. Different storage portions 201 can be disposed at different positions and have different sizes, and a storage compartment can have different temperatures so that different needs of the user can be met. The refrigerator 200 of the present invention may also be designed for use as a part in a smart home. In the present invention, "separately disposed" means that bodies are spaced apart by a certain distance, and an electric circuit is connected by an additional accessory.

With reference to FIG. 6 and FIG. 7, the air supply pipeline 300 may include an air supply pipe 301 and at least one air supply branch pipe 302, and the number of the air supply branch pipes 302 is the same as the number of the storage portions 201. The inlet end of the air supply pipe 301 is in abutting joint with the cold supply port of the refrigeration module 202, and the outlet end of the air supply pipe 301 is located above the refrigeration module 202. The inlet end of the air supply branch pipe 302 is in abutting joint with the outlet end of the air supply pipe 301, and the outlet end of the air supply branch pipe 302 is connected to the storage portion 201. The air supply pipe 301 and the air supply branch pipe 302 of the air supply pipeline 300 may be of an integrated structure, and may also be of a split structure. The split structure here refers to that the air supply pipe 301 may be preassembled with the refrigeration module 202, the air supply branch pipe 302 may be preassembled with the storage portion 201, and then the air supply pipe 301 and the air supply branch pipe 302 are connected to form the air supply pipeline 300. When there is only one storage portion 201, the air supply pipeline 300 of the integrated structure is more suitable. When there are two or more storage portions 201, a plurality of air supply pipelines 300 of the integrated structure can be used, and at this moment, the refrigeration module 202 has a plurality of cold supply ports; a plurality of air supply pipelines 300 of a split structure can also be used, at this moment, the refrigeration module 202 likewise has a plurality of cold supply ports; two or more air supply pipes 301 are assembled by abutting joint on the refrigeration module 202, and then one air supply branch pipe 302 is respectively connected to each air supply pipe 301 to constitute the whole air supply pipeline 300; it is also possible to use the air supply pipeline 300 first integrated and then divided of the split structure, at this moment, the refrigeration module 202 only has one cold supply port, one air supply pipe 301 is assembled by abutting joint on the refrigeration module 202, and then the air supply pipe 301 is connected to two or more air supply branch pipes 302 by using a branching mechanism such as a three-way pipe 303. As described in the foregoing description of the present invention, the split refrigerator 200 can be freely provided with one or more storage portions 201 as needed, and can be more conveniently adapted to different needs by using the air supply pipeline 300 first integrated and then divided, while simplifying the manufacturing process of the refrigeration module 202. For example, the refrigeration module 202 has one cold supply port, one air supply pipe 301 is assembled by abutting joint on the cold supply port, one three-way pipe 303 is disposed at the outlet end of the air supply pipe 301, and two outlets of the three-way pipe 303 are sealed in advance, so that when the user needs one storage portion 201, only one outlet of the three-way pipe 303 needs to be opened to connect one air supply branch pipe 302; when the user requires two storage portions 201, both outlets of the three-way pipe 303 may be opened to connect two air supply branch pipes 302. Likewise, the air return pipeline 400 may include an air return pipe 401 and at least one air return branch pipe 402; the number of the air return branch pipes 402 is the same as the number of the storage portions 201; one end of the air return pipe 401 is in abutting joint with the air return port, the other end of the air return pipe 401 is in abutting joint with at least one air return branch pipe 402, the other end of the air return branch pipe 402 is connected into the corresponding storage portion 201, and air in the storage portion 201 flows into the refrigeration module 202 via the corresponding air return branch pipe 402 and the air return pipe 401. The threading pipeline 300 may include a first threading pipe 501 and at least one second threading pipe 502; the number of the second threading pipes 502 is the same as the number of the storage portions 201; one end of the first threading pipe 501 is in abutting joint with the electrical connection port, the other end of the first threading pipe 501 is in abutting joint with at least one second threading pipe 502, and the other end of the second threading pipe 502 is connected into the corresponding storage portion 201, so as to realize circuit connection between the storage portion 201 and the refrigeration module 202.

Figure 10:
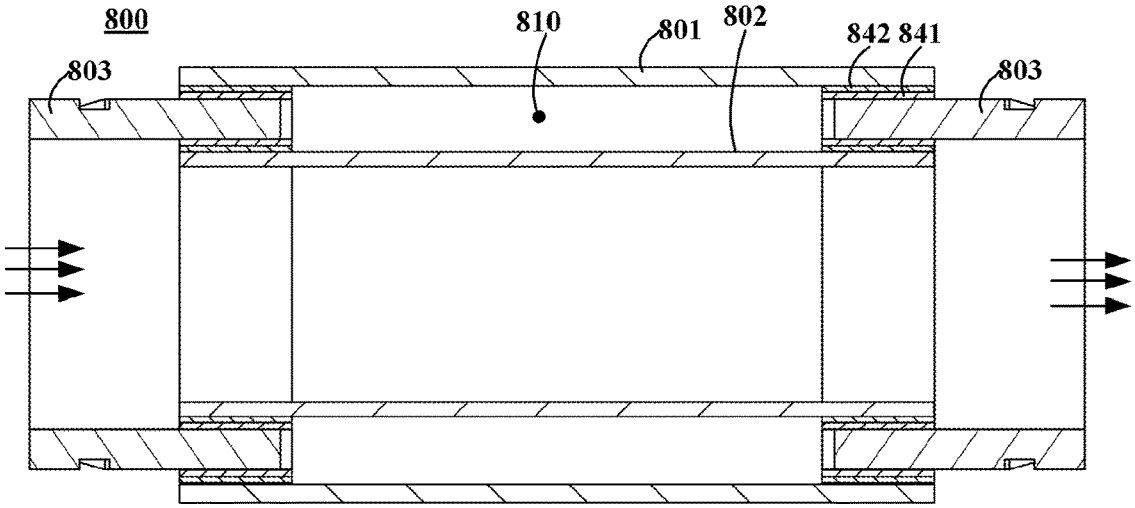
FIG. 10 is a structural schematic view of a vacuum pipe according to one embodiment of the present invention.
Figure 11:
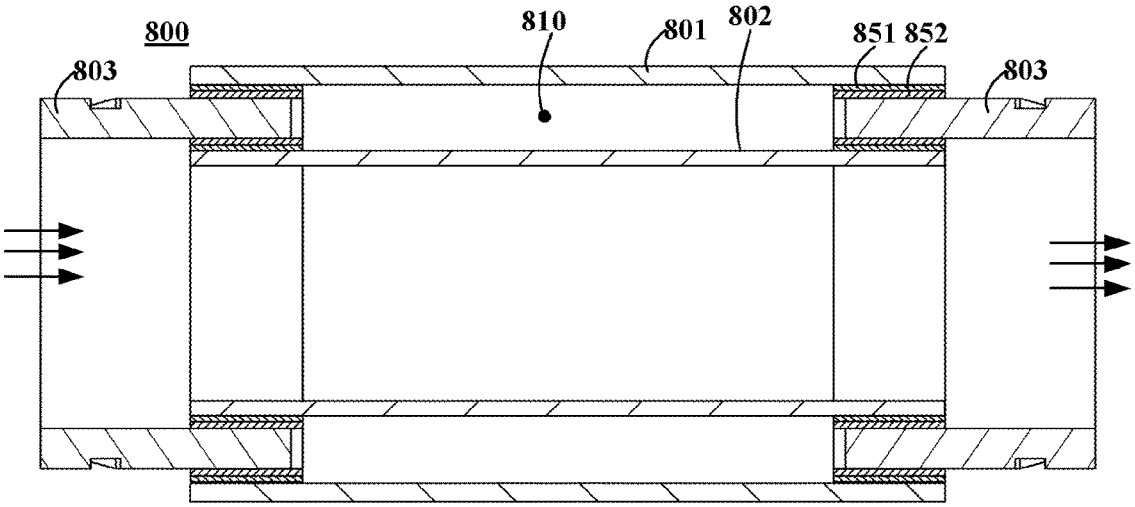
FIG. 11 is a structural schematic view of a vacuum pipe according to another embodiment of the present invention.
Figure 12:
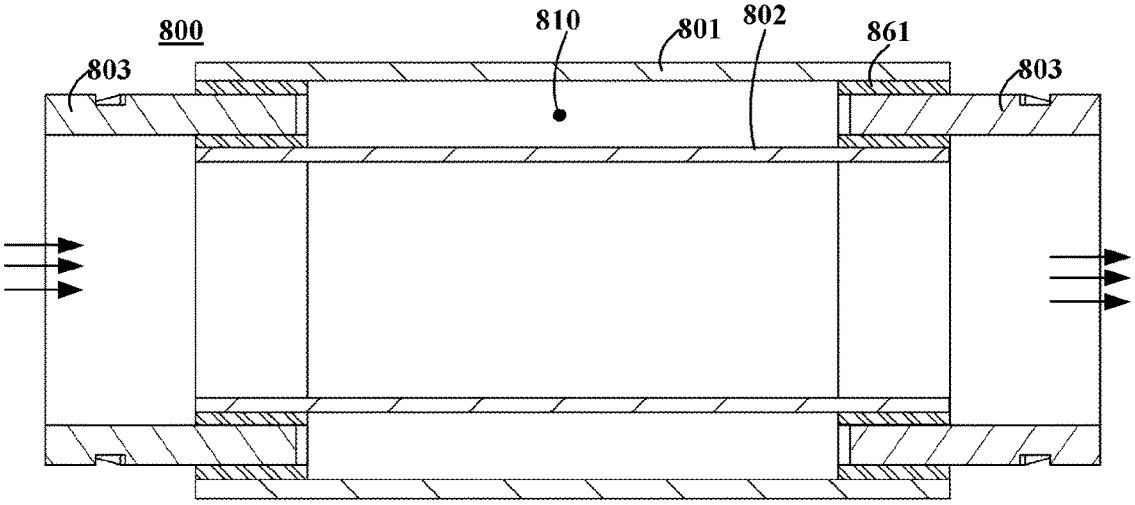
FIG. 12 is a structural schematic view of a vacuum pipe according to still another embodiment of the present invention.

At least a part of the air supply pipeline 300 and/or the air return pipeline 400 is a vacuum pipe 800. FIG. 10 is a structural schematic view of a vacuum pipe 800 according to one embodiment of the present invention. FIG. 11 is a structural schematic view of a vacuum pipe 800 according to another embodiment of the present invention. FIG. 12 is a structural schematic view of a vacuum pipe 800 according to still another embodiment of the present invention. The vacuum pipe 800 includes an outer pipe 801, an inner pipe 802 and an end sealing connection piece 803, wherein the outer pipe 801 is disposed outside the inner pipe 802 in a sleeving mode and is arranged at an interval from the inner pipe 802; the end sealing connection piece 803 is configured to be sandwiched between the outer pipe 801 and the inner pipe 802 to seal and fix the outer pipe 801 and the inner pipe 802, and a vacuum cavity 810 is defined among the outer pipe 801, the inner pipe 802 and the end sealing connection piece 803. Preferably, the air supply pipeline 300 and the air return pipeline 400 are the vacuum pipe 800 as a whole. The vacuum pipe 800 is used to supply air and conduct cooling, which can avoid the heat loss and condensation. The vacuum pipe 800 reduces convective heat transfer by vacuumizing between two layers of hermetically sealed pipes. The end sealing connection piece 803 is sandwiched between the two layers of pipes to seal and fix the two layers of pipes, which can make the outer pipe 801 and the inner pipe 802 can always maintain a certain distance, so that the structure of the whole vacuum pipe 800 is stable, the independent appearance structure is maintained, and the vacuum cavity 810 can maintain a stable vacuum state. The vacuum degree of the vacuum cavity 810 of the vacuum pipe 800 is $10^{-1}$-$10^{-3}$ Pa.

The outer pipe 801 is made of a metal pipe fitting; the inner pipe 802 is made of a metal pipe fitting; the end sealing connection piece 803 is made of quartz glass. The two layers of pipes are both metal pipes, which can stabilize the structure of the vacuum pipe 800. Preferably, both the outer pipe 801 and the inner pipe 802 are stainless steel pipes, for example, 304 stainless steel. The stainless steel pipe can ensure the strength of the vacuum pipe 800, is attractive in appearance, can reduce radiation heat transfer, and can avoid air leakage caused by corrosion and rusting at the same time. The end sealing connection piece 803 is made of quartz glass and has the characteristics of low thermal conductivity and low outgassing rate, which can solve the thermal bridge heat transfer problem of the vacuum pipe 800.

The thickness of the outer pipe 801 and the thickness of the inner pipe 802 may be the same or may be different. The outer pipe 801 has a thickness of 1 mm to 1.5 mm, such as 1 mm, 1.2 mm, and 1.5 mm. The inner pipe 802 has a thickness of 1 mm to 1.5 mm, such as 1 mm, 1.2 mm, and 1.5 mm. The end sealing connection piece 803 may be an annular component, and the portion of the end sealing connection piece 803 sandwiched between the outer pipe 801 and the inner pipe 802 has a length of 10 mm to 15 mm, such as 10 mm, 12 mm, and 15 mm. Through a large number of experimental studies, it is preferable to limit the length of the end sealing connection piece 803 between the outer pipe 801 and the inner pipe 802 in the range of 10 mm to 15 mm, which can ensure that the end sealing connection piece 803 seals tightly the outer pipe 801 and the inner pipe 802, and at the same time can avoid that because the end sealing connection piece 803 is too large, the volume of the vacuum cavity 810 is reduced, so that the thermal insulation effect of a vacuum thermal insulator 100 is good. The distance between the outer pipe 801 and the inner pipe 802 is 0.5 mm to 20 mm, for example, 0.5 mm, 2 mm, 5 mm, 10 mm, 15 mm, and 20 mm. Setting the distance between the outer pipe 801 and the inner pipe 802 to be 0.5 mm-20 mm can satisfy different thermal insulation and product requirements. The inner diameter of the inner pipe 802 is 3-5 times the distance between the outer pipe 801 and the inner pipe 802.

As shown in FIG. 10, in some embodiments, the end sealing connection piece 803 forms nickel plated layers 841 on its inner and outer surfaces, respectively; a solder piece 842 is disposed between the nickel plated layer 841 and the outer pipe 801 and the inner pipe 802, and the end sealing connection piece 803 is sealed and fixed to the outer pipe 801 and the inner pipe 802 by welding the nickel plated layer 841 and the solder piece 842. The nickel plated layer 841 is respectively formed on the inner and outer surfaces of the end sealing connection piece 803, and then the solder pieces 842 are disposed between the nickel plated layer 841 and the outer pipe 801 and the inner pipe 802, so that the nickel plated layer 841 and the solder piece 842 are welded to seal and fix the end sealing connection piece 803 to the outer pipe 801 and the inner pipe 802, which can enable the end sealing connection piece 803 be tightly sealed to the outer pipe 801 and the inner pipe 802, so as to avoid air leakage caused by untight sealing. The solder piece 842 may be selected from, for example, a silver-copper solder piece. The preparation process of the vacuum pipe 800 includes: performing nickel plating treatment on the end sealing connection piece 803, then sandwiching the end sealing connection piece 803 between the outer pipe 801 and the inner pipe 802, respectively placing the solder pieces 842 between the end sealing connection piece 803 and the outer pipe 801 and the inner pipe 802, then pumping out air between the outer pipe 801 and the inner pipe 802 through gaps between the end sealing connection piece 803 and the outer pipe 801 and the inner pipe 802, and finally welding and sealing the end sealing connection piece 803 to the outer pipe 801 and the inner pipe 802. The nickel plating treatment for the end sealing connection piece 803 may use a method of nickel plating on quartz glass as disclosed in the prior art. For example, the quartz glass is pre-treated firstly and then chemically plated with a chemical plating solution, wherein pre-treatment steps include: removing a protective layer, degreasing, roughening, sensitizing, activating, and heat treatment; the chemical plating solution for use is a mixed solution composed of a nickel salt, a reducing agent, a buffering agent, a complexing agent, etc.; the pre-treated bare end sealing connection piece 803 is chemically plated in the prepared chemical plating solution at a temperature of 80° C.-90° C. for a certain period of time, and then rinsed with deionized water, namely, nickel plating on the end sealing connection piece 803 is completed. The welding and sealing treatment and the vacuumizing treatment are performed in a vacuum furnace. The welding temperature of the welding and sealing treatment is 750° C.-850° C., for example 800° C. After the welding and sealing treatment is completed, thermal insulation is performed for 1 min-2 min, and then the vacuum pipe 800 is taken out of the vacuum furnace. The vacuumizing treatment is performed by vacuumizing to a degree of vacuum of $10^{-1}$ to $10^{-3}$ Pa.

As shown in FIG. 11, in some other embodiments, metal pieces 851 are disposed between the end sealing connection piece 803 and the outer pipe 801 and the inner pipe 802; a glass powder slurry 852 is disposed between the end sealing connection piece 803 and the metal piece 851, and the end sealing connection piece 803 is sealed and fixed to the outer pipe 801 and the inner pipe 802 by melting the glass powder slurry 852 and welding the metal piece 851. The glass powder slurry 852 is used to fix the metal pieces 851 on the inner and outer surfaces of the end sealing connection piece 803 respectively, and then the metal pieces 851 are welded to seal and fix the end sealing connection piece 803 to the outer pipe 801 and the inner pipe 802, so that the end sealing connection piece 803 can be tightly sealed to the outer pipe 801 and the inner pipe 802, and air leakage caused by untight sealing can be avoided. A metal strap may be used for the metal piece 851. A material that can compensate for the difference in the thermal expansion coefficients of the quartz glass and the stainless steel pipe is selected for the metal piece 851. The metal piece 851 is made of a kovar alloy material, for example, ferrochrome, fernico, etc. The preparation process of the vacuum pipe 800 includes: coating the metal piece 851 with the glass powder slurry 852, then respectively adhering the metal piece 851 to the inner and outer surfaces of the end sealing connection piece 803, fixing the metal piece 851 to the inner and outer surfaces of the end sealing connection piece 803 by heating and melting, then sandwiching the end sealing connection piece 803 between the outer pipe 801 and the inner pipe 802, then pumping out air between the outer pipe 801 and the inner pipe 802 through gaps between the end sealing connection piece 803 and the outer pipe 801 and the inner pipe 802, and finally welding and sealing the end sealing connection piece 803 to the outer pipe 801 and the inner pipe 802. The temperature of heating and melting is 440 C to 460 C, the slurry can be melted, but glass cannot be melted. The welding and sealing treatment and the vacuumizing treatment are performed in a vacuum furnace. The welding temperature of the welding and sealing treatment is 750° C.-850° C., for example 800° C. After the welding and sealing treatment is completed, thermal insulation is performed for 1 min-2 min, and then the vacuum pipe 800 is taken out of the vacuum furnace. The vacuumizing treatment is performed by vacuumizing to a degree of vacuum of $10^{-1}$ to $10^{-3}$ Pa.

As shown in FIG. 12, in still some other embodiments, a silica gel layer 861 is disposed between the end sealing connection piece 803 and the outer pipe 801 and the inner pipe 802, and the end sealing connection piece 803 is sealed and fixed to the outer pipe 801 and the inner pipe 802 by bonding the silica gel layer 861. The end sealing connection piece 803 can be tightly sealed to the outer pipe 801 and the inner pipe 802 by using the silica gel layer 861 to avoid air leakage caused by untight sealing Quick-drying silica gel is used as silica gel and has the strength property of structural adhesive and the toughness of silica gel, has good airtightness, and can be tightly combined with the quartz glass and the stainless steel pipe.

With reference to FIG. 4 again, the air supply pipeline 300 uses the vacuum pipe 800. An air supply joint 342 is disposed outside the inlet end of the air supply pipeline 300, and the air supply joint 342 passes through the cold supply port of the refrigeration module 202. The fixing piece 352 at the cold supply port is matched with the air supply joint 342 within the evaporator compartment 600 in threaded connection to fix the air supply pipeline 300 to the refrigeration module 202. The air supply pipeline 300 and the refrigeration module 202 are fixed by the cooperation of the air supply joint 342 and the fixing piece 352, so that the structure is ingenious, mounting is simple and stability is good. Specifically, the end sealing connection piece 803 has a first section 831 located between the outer pipe 801 and the inner pipe 802, and a second section 832 beyond the ends of the outer pipe 801 and the inner pipe 802. The air supply joint 342 is fixed to the second section 832 of the end sealing connection piece 803 in a clamped connection mode. The air supply joint 342 has a joint base 3421 and a joint protrusion 3422, the inner side surface of the joint base 3421 is attached to the cover plate 620, and the end of the joint protrusion 3422 goes beyond the cover plate 620 and the outer side surface of the portion going beyond is provided with a threaded structure corresponding to the threaded structure of the fixing piece 352. A rubber sealing ring 360 is further disposed in a contact area between the air supply joint 342 and the cover plate 620.

Hereinafter, the structure of the storage portion 201 of the refrigerator 200 of the present invention will be described in detail.

Figure 13:
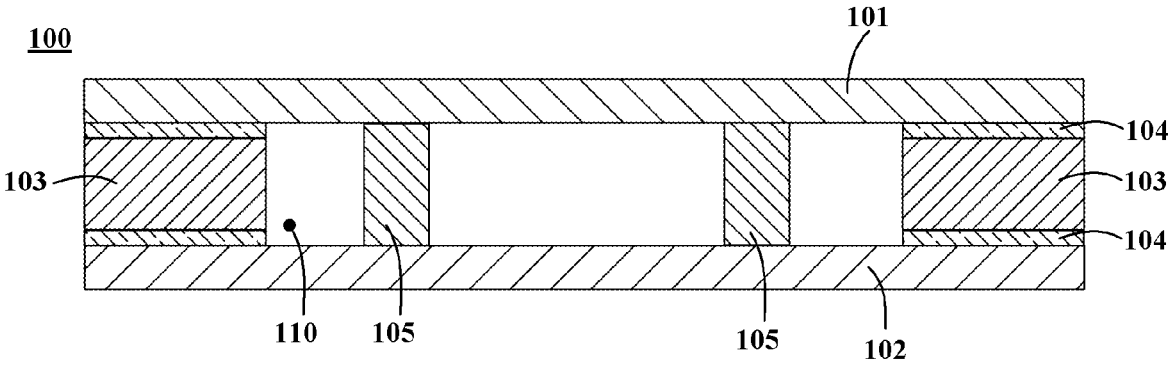
FIG. 13 is a structural schematic view of a vacuum thermal insulator according to one embodiment of the present invention.

As shown in FIG. 6, in some embodiments, the storage portion 201 of the refrigerator 200 of the present invention has a cabinet 210 and a door body 220, a storage space is defined in the cabinet 210, the door body 220 is disposed on the front side of the cabinet 210 to open and close the storage space, and the cabinet 210 and the door body 220 are both vacuum thermal insulators 100. FIG. 13 is a structural schematic view of the vacuum thermal insulator 100. The vacuum thermal insulator 100 includes: a first plate 101, a second plate 102, and a sealing connection piece 103. The second plate 102 is oppositely spaced from the first plate 101. The sealing connection piece 103 is sandwiched between the first plate 101 and the second plate 102 to seal and fix the first plate 101 and the second plate 102, and a vacuum cavity 110 is defined among the first plate 101, the second plate 102 and the sealing connection piece 103. The vacuum degree of the vacuum cavity 110 of the vacuum thermal insulator 100 is $10^{-1}$-$10^{-3}$ Pa. The cabinet 210 and the door body 220 of the refrigerator 200 of the present invention are the vacuum thermal insulators 100, which can ensure the thermal insulation effect of the refrigerator 200; the vacuum thermal insulator 100 reduces convective heat transfer by vacuumizing between two layers of hermetically sealed plates. By sandwiching the sealing connection piece 103 between the first plate 101 and the second plate 102 to seal and fix the two layers of plates, a certain distance between the first plate 101 and the second plate 102 can be maintained at all times, so that the structure of the whole vacuum thermal insulator 100 is stable and an independent appearance structure can be maintained. By using the vacuum thermal insulator 100 to form the cabinet 210, the wall thickness of the refrigerator 200 can be kept small while the thermal insulation effect of the refrigerator 200 is guaranteed, and at the same time, the internal volume of the refrigerator 200 can be increased accordingly, which is particularly suitable for an embedded refrigerator, and can greatly improve the utilization rate of space and improve the user experience.

The vacuum thermal insulator 100 may also include: a plurality of supporting pieces 105, disposed in the vacuum cavity 110, and configured to be fixed to the first plate 101 and/or the second plate 102 to provide supporting between the first plate 101 and the second plate 102. By disposing the plurality of supporting pieces 105 in the vacuum cavity 110, the first plate 101 and the second plate 102 can be supported, which enhances the strength of the entire vacuum thermal insulator 100; the supporting piece 105 is directly fixed to the first plate 101 and/or the second plate 102, so that the disposing process of the supporting piece 105 is simplified and the manufacturing process of the entire vacuum thermal insulator 100 is simplified. The supporting piece 105 is preferably made of quartz glass or polytetrafluoroethylene, and is adhesively fixed to the first plate 101 and/or the second plate 102 by using epoxy resin or silica gel.

The composition and manufacturing method of the vacuum thermal insulator 100 of the present invention are briefly described below. The first plate 101 is made of a stainless steel plate, and the second plate 102 is made of a stainless steel plate. A stainless steel plate with the inner surface being a mirror surface or being evaporated may be used, for example, 304 stainless steel. The stainless steel plate can ensure the strength of the vacuum thermal insulator 100, is attractive in appearance, can reduce radiation heat transfer, and can avoid air leakage caused by corrosion and rusting at the same time. The sealing connection piece 103 is made of quartz glass and the quartz glass has the characteristics of low thermal conductivity and low outgassing rate, which can solve the thermal bridge heat transfer problem of the vacuum thermal insulator 100. A sealing structure 104 is also formed between the first plate 101 and the second plate 102 and the sealing connection piece 103. Since the thermal expansion coefficients of the quartz glass and the stainless steel plate are different by 15 times, the sealing structure 104 needs to be elastic and can be tightly combined with the quartz glass and the stainless steel plate so as to ensure tight connection between the quartz glass and the stainless steel plate. The sealing structure 104 may include a nickel plated layer and a solder piece; the upper and lower surfaces of the sealing connection piece 103 respectively form the nickel plating layer, a silver-copper solder piece is arranged between the nickel plated layer and the first plate 101 and the second plate 102, and the sealing connection piece is sealed and fixed to the first plate 101 and the second plate 102 by welding the nickel plated layer and the silver-copper solder piece. The sealing structure 104 may further include a kovar alloy piece and a glass powder slurry; the kovar alloy piece is respectively disposed between the sealing connection piece 103 and the first plate 101 and the second plate 102; the glass powder slurry is disposed between the sealing connection piece 103 and the kovar alloy piece; and the sealing connection piece 103 is sealed and fixed to the first plate 101 and the second plate 102 by melting the glass powder slurry and welding the kovar alloy piece. The sealing structure 104 may further include a quick-drying silica gel layer; the silica gel layer is respectively disposed between the sealing connection piece 103 and the first plate 101 and the second plate 102, and the sealing connection piece 103 is sealed and fixed to the first plate 101 and the second plate 102 by bonding the silica gel layer.

Figure 14:
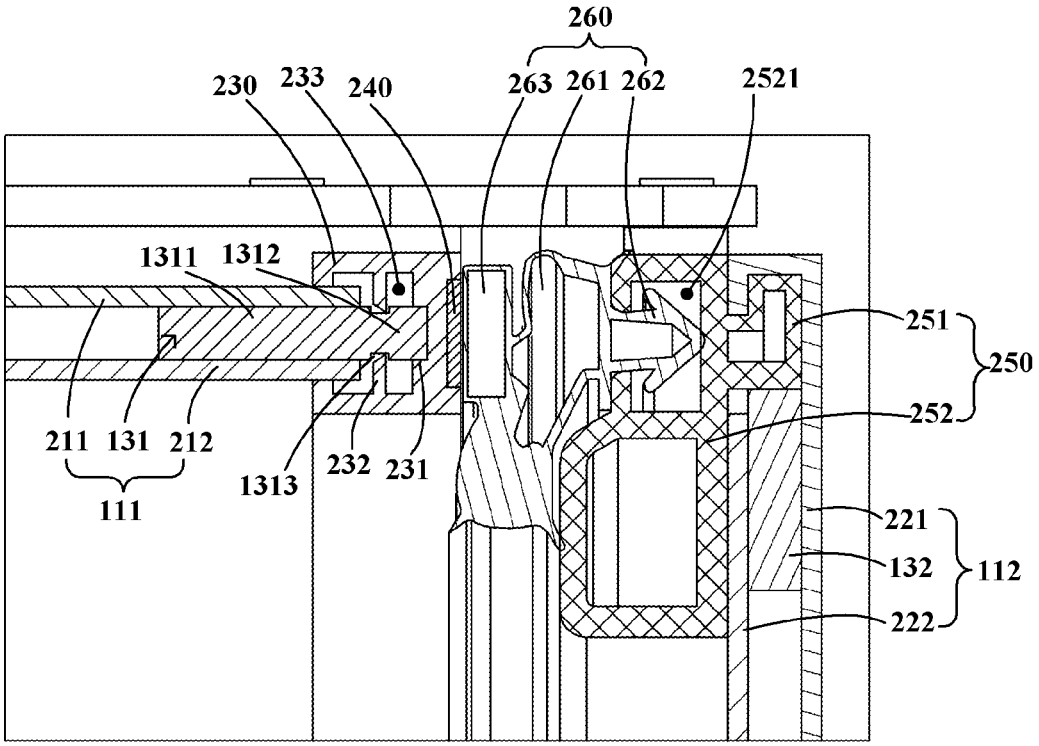
FIG. 14 is a schematic view showing cooperation of a cabinet and a door body of the refrigerator shown in FIG. 6.

FIG. 14 is a schematic view showing cooperation of the cabinet 210 and the door body 220 of the storage portion 201 of the refrigerator 200 shown in FIG. 6, and is a partially enlarged view of a part C in FIG. 8. For convenience of description, the vacuum thermal insulator 100 constituting the cabinet 210 is referred to as a first vacuum thermal insulator 111, an outer shell 211 is namely the first plate 101 of the first vacuum thermal insulator 111, an inner shell 212 is namely the second plate 102 of the first vacuum thermal insulator 111, and the sealing connection piece 103 of the first vacuum thermal insulator 111 is described as a first sealing connection piece 131. Accordingly, the vacuum thermal insulator 100 constituting the door body 220 is referred to as a second vacuum thermal insulator 112, an outer plate 221 is namely the first plate 101 of the second vacuum thermal insulator 112, an inner plate 222 is namely the second plate 102 of the second vacuum thermal insulator 112, and the sealing connection piece 103 of the second vacuum thermal insulator 112 is described as a second sealing connection piece 132.

A first frame 230 is configured to wrap the end of the first vacuum thermal insulator 111, wherein the side of the first frame 230 away from the first vacuum thermal insulator 111 is provided with a metal strip 240 for magnetically attracting and sealing a door seal 260. The first frame 230 is provided with a groove (not numbered in the figure) on a side away from the first vacuum thermal insulator 111, and the metal strip 240 is adhesively fixed to the first frame 230. The metal strip 240 may be stainless steel or carbon steel electroplated with dimensions of a width about 10 mm*a thickness of 2 mm. The metal strip 240 may be adhesively fixed to the first frame 230 by using quick-drying silica gel. The first sealing connection piece 131 has a first section 1311 located between the outer shell 211 and the inner shell 212, and a second section 1312 going beyond the ends of the outer shell 211 and the inner shell 212; the first frame 230 is configured to be cooperatively fixed to the second section 1312, thereby being fixed to the first vacuum thermal insulator 111. The first frame 230 is preferably fixed to the second section 1312 in a clamped connection mode, which has the advantages of simple structure and convenient mounting. The assembly process of the cabinet 210 is firstly sealing and fixing the first sealing connection piece 131 to the outer shell 211 and the inner shell 212 and vacuumizing to form the first vacuum thermal insulator 111; then, fixing the first frame 230 to which the metal strip 240 is adhered with the first vacuum thermal insulator 111 in a clamped connection mode. The width of the first section 1311 is preferably 10 mm-15 mm, which can ensure that the first sealing connection piece 131 tightly seals the outer shell 211 and the inner shell 212, and at the same time can prevent that the first sealing connection piece 131 is too large, and consequently the volume of the vacuum cavity 110 is reduced, so that the heat insulation effect of the first vacuum thermal insulator 111 is good. The width of the second section 1312 is about 10 mm, so that the first vacuum thermal insulator 111 can be stably assembled with the first frame 230 without too much heat leakage. The first frame 230 can be made of an ABS material, a PP material, etc. A groove 231 is formed on the inner side face of the first frame 230 close to the first vacuum thermal insulator 111 at a position corresponding to the end of the second section 1312; the end of the second section 1312 is clamped into the groove 231 of the first frame 230. In addition, the second section 1312 respectively forms grooves 1313 on its outer side surface located on one side of the outer shell 211 and on its inner side surface located on one side of the inner shell 212; a protrusion 232 is respectively formed on the inner side surface of the first frame 230 close to the first vacuum thermal insulator 111 at a position corresponding to the groove 1313 of the second section 1312; the protrusion 232 is fixed to the groove 1313 of the second section 1312 in a clamped connection mode. By the double groove and protrusion structure, stable connection of the frame and the first vacuum thermal insulator 111 can be achieved. The tail end of the protrusion 232 of the first frame 230 may be disposed into a sharp corner portion to be used as undercut to facilitate being clamped into the groove 1313 of the second section 1312 during assembly. At the same time, after mounting is completed, the first frame 230 and the first vacuum thermal insulator 111 are bounded by the protrusion 232 of the first frame 230 to define two cavity-like structures 233 so as to play a heat insulating role and block heat leakage at the first frame 230. The side of the first sealing connection piece 131 located on the outer shell 211 may be regarded as the outer side surface of the first sealing connection piece 131, and the side located on the inner shell 212 may be regarded as the inner side surface of the first sealing connection piece 131, wherein the outer side surface of the first section 1311 is attached to the outer shell 211, and the outer side surface of the second section 1312 faces the side where the outer shell 211 is located; the inner side surface of the first section 1311 is attached to the inner shell 212, and the inner side surface of the second section 1312 faces the side where the inner shell 212 is located. It can be understood that when the first vacuum thermal insulator 111 is described as the top wall of the cabinet 210, the outer side surface of the first sealing connection piece 131 is namely the upper surface thereof, and the inner side surface of the first sealing connection piece 131 is namely the lower surface thereof; when the first vacuum thermal insulator 111 is described as the bottom wall of the cabinet 210, the outer side surface of the first sealing connection piece 131 is namely the lower surface thereof, and the inner side surface of the first sealing connection piece 131 is namely the upper surface thereof; when the first vacuum thermal insulator 111 is described as the side wall of the cabinet 210, the outer side surface of the first sealing connection piece 131 is namely the surface thereof away from the storage space, and the inner side surface of the first sealing connection piece 131 is namely the surface thereof close to the storage space.

The tail end of the outer plate 221 of the door body 220 is bent such that the end of the outer plate 221 is disposed opposite to the end of the inner plate 222 with a gap. A second frame 250 is configured to be fixed to the second vacuum thermal insulator 112 through a gap, and a door seal 260 is mounted on the side of the second frame 250 away from the second vacuum thermal insulator 112. The structure of the door body 220 is ingenious, and by bending the outer plate 221, the gap is defined between the outer plate 221 and the inner plate 222, and the second frame 250 is fixed to the second vacuum thermal insulator 112 in cooperation via the gap, the second frame 250 and the second vacuum thermal insulator 112 can be firmly fixed, and at the same time, the door body 220 can be kept integrated in appearance, so as to improve the sensory experience of the user. The assembly process of the door body 220 is firstly sealing and fixing the second sealing connection piece 132 to the outer plate 221 and the inner plate 222 and vacuumizing to form the second vacuum thermal insulator 112; then fixing the second frame 250 to the second vacuum thermal insulator 112, and finally, fixing the door seal 260 to the second frame 250. The height of the second sealing connection piece 132 is preferably 10 mm-15 mm, which can ensure that the second sealing connection piece 132 seals tightly the outer plate 221 and the inner plate 222, and at the same time can prevent that the second sealing connection piece 132 is too large, and consequently the volume of the vacuum cavity 110 is reduced, so that the heat insulation effect of the second vacuum thermal insulator 112 is good. The second frame 250 can be made of an ABS material, a PP material etc. Specifically, the projection of the end of the second sealing connection piece 132 in the vertical direction is between the end of the outer plate 221 and the end of the inner plate 222; the second frame 250 has a first frame portion 251 and a second frame portion 252, the first frame portion 251 is clamped into a space defined by the outer plate 221, the gap and the second sealing connection piece 132, and the second frame portion 252 extends from the first frame portion 251 toward the side away from the second vacuum thermal insulator 112. The side face of the second frame portion 252 away from the first frame portion 251 is recessed inwards to form an accommodating cavity 2521; the door seal 260 is fixed to the second frame 250 through the accommodation cavity 2521. The door seal 260 includes an air bag 261, a base 262 and a magnetic strip 263, wherein the base 262 extends from the air bag 261 towards the door body 220 and is accommodated in the accommodation cavity 2521; the magnetic strip 263 is disposed on the air bag 261 and matched with the metal strip 240 to attract the dock seal 260 onto the cabinet 210.

Figure 15:
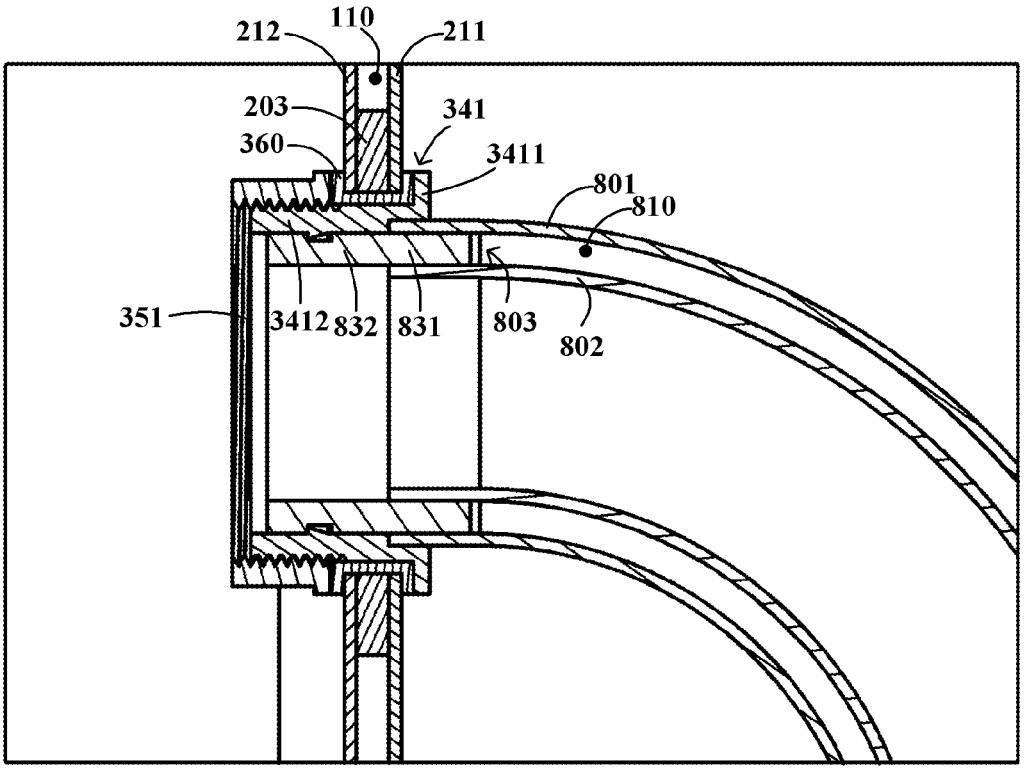
FIG. 15 is a schematic view showing cooperation of a storage portion and an air supply pipeline of the refrigerator shown in FIG. 6.
Figure 16:
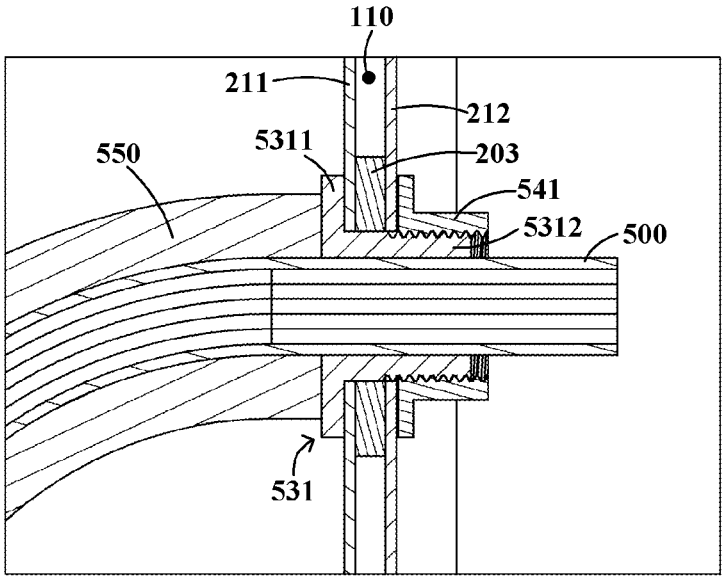
FIG. 16 is a schematic view showing cooperation of the storage portion and a threading pipeline of the refrigerator shown in FIG. 6.

The matching structure of the air supply pipeline 300, the air return pipeline 400, and the threading pipeline 500 with the cabinet 210 when the cabinet 210 of the storage portion 201 is the vacuum thermal insulator 100 will be described below. FIG. 15 is a schematic view showing cooperation of the storage portion 201 and the air supply pipeline 300 of the refrigerator 200 shown in FIG. 6, and is a partially enlarged view of a part F in FIG. 9. FIG. 16 is a schematic view showing cooperation of the storage portion 201 and the threading pipeline 500 of the refrigerator 200 shown in FIG. 6, and is a partially enlarged view of a part D in FIG. 8.

An air supply joint 341 is disposed outside the outlet end of the air supply pipeline 300, and the air supply joint 341 passes through an air supply mounting opening formed in the cabinet 210. The fixing piece 351 is matched with the air supply joint 341 by threaded connection in the cabinet 210, thereby fixing the air supply pipeline 300 to the air supply joint 341. The air supply pipeline 300 and the cabinet 210 are fixed by the cooperation of the air supply joint 341 and the fixing piece 351, so that the structure is ingenious, mounting is simple and stability is good. Specifically, the end sealing connection piece 803 has the first section 831 located between the outer pipe 801 and the inner pipe 802, and the second section 832 beyond the ends of the outer pipe 801 and the inner pipe 802. The air supply joint 341 is matched with the second section 832 of the end sealing connection piece 803 in a clamped connection mode. The air supply joint 341 has a joint base 3411 and a joint protrusion 3412, the inner side surface of the joint base 3411 is attached to the outer shell 211, the end of the joint protrusion 3412 goes beyond the inner shell 212 and the outer side surface of the portion going beyond is provided with a threaded structure corresponding to the threaded structure of the fixing piece 351. A rubber sealing ring 360 is further disposed in a contact area between the air supply joint 341 and the cabinet 210. In particular, the outer shell 211 and the inner shell 212 of the cabinet 210 are provided with quartz glass heat insulation pieces 203 around the air supply mounting opening by one circle to improve heat transfer at the air supply mounting opening. The heat insulation piece 203 is an annular component, and the annular width may be 10±5 mm, preferably 10 mm to 15 mm. The annular width of the heat insulation piece 203 is 10 mm to 15 mm, which can ensure that the heat insulation piece 203 tightly seals the outer shell 211 and the inner shell 212, and at the same time can avoid that because the heat insulation piece 203 is too large, the volume of the vacuum cavity 110 is reduced, so that the heat insulation effect of the vacuum thermal insulator 100 is good. It will be appreciated that the heat insulation piece 203 may essentially be considered as the sealing connection piece 103 at the opening in the vacuum thermal insulator 100, and the heat insulation piece 203 is sandwiched between the first plate 101 and the second plate 102 to seal the vacuum thermal insulator 100 at the opening. The sealing structure of the heat insulation piece 203 and the first plate 101 and the second plate 102 can refer to the aforementioned sealing structure of the sealing connection piece 103 and the first plate 101 and the second plate 102, which will not be described in detail herein. Similarly, the cabinet 210 is provided with an air return mounting opening, and the air return pipeline 400 is fixed to the cabinet 210 at the air return mounting opening through cooperation of an air return joint and the fixing piece.

A threading joint 531 is disposed on the outside of the threading pipeline 500 close to the cabinet 210, and the threading joint 531 passes through an electrical connection mounting opening formed in the cabinet 210. The fixing piece 541 is matched with the threading joint 531 by threaded connection in the cabinet 210, so as to fix the threading pipeline 500 to the cabinet 210. The threading pipeline 500 is fixed to the cabinet 210 by the cooperation of the threading joint 531 and the fixing piece 541, so that the structure is ingenious, mounting is simple, and the stability is good. Specifically, the threading joint 531 has a joint base 5311 and a joint protrusion 5312. The inner side surface of the joint base 5311 is attached to the outer side surface of the outer shell 211. The end of the joint protrusion 5312 goes beyond the inner shell 212 and the outer side surface of the portion going beyond is provided with a threaded structure corresponding to the threaded structure of the fixing piece 541. The threading pipeline 500 and the threading joint 531 can be integrally injection-molded to reduce assembly steps and improve assembly efficiency. The threading joint 531 may be made of a PVC material. The fixing piece 541 may be made of an ABS or PS material. Likewise, the outer shell 211 and the inner shell 212 of the cabinet 210 are provided with quartz glass heat insulation pieces 203 around the electrical connection mounting opening by one circle, so as to improve the heat transfer at the electrical connection mounting opening.

The refrigeration module 202 of the embodiment of the present invention has the module body in which the mounting space is defined, and the refrigeration system for generating cooling capacity is disposed in the mounting space. Since the cold supply port is disposed in the module body, and the cold supply port is configured to be detachably connected to the external pipeline 300, the cooling capacity generated by the refrigeration system is supplied into the external pipeline 300 by the cold supply port. The refrigeration module 202 can be sold and used independently, and the using experience of the user can be improved especially when it is used as a part of the split refrigerator 200.

By separately disposing the refrigeration module 202 and the storage portion 201 of the refrigerator 200 of the embodiment of the present invention, the storage portion 201 does not need to give way for the refrigeration system, which can greatly increase the internal volume of the refrigerator 200; the refrigeration module 202 is independently disposed and may be free to match with one or more same or different storage portions 201 as desired Hereto, those skilled in the art should realize that although a plurality of exemplary embodiments of the present invention have been shown and described in detail herein, without departing from the spirit and scope of the present invention, many other variations or modifications that conform to the principles of the present invention can still be directly determined or deduced from the contents disclosed in the present invention. Therefore, the scope of the present invention should be understood and recognized as covering all these other variations or modifications.

The invention claimed is:

1. A refrigeration module, comprising:

a module body, defining a mounting space; and a refrigeration system, disposed in the mounting space and used for generating cooling capacity; wherein a cold supply port is disposed in the module body, the cold supply port is configured to be detachably connected to an external pipeline, and cooling capacity generated by the refrigeration system is supplied into the external pipeline by the cold supply port, wherein the refrigeration system is a compression refrigeration system having a compressor, a condenser, and an evaporator, wherein the module body comprises:

an evaporator compartment in which the evaporator is disposed; and a compressor compartment, disposed separately from and located behind the evaporator compartment, the compressor and the condenser being disposed in the compressor compartment, wherein the evaporator compartment comprises a box body and a cover plate, wherein the box body has a bottom wall and side walls, and the box body defines an upward opening, wherein the cover plate is located above the box body and is configurable to close the opening, and a containing cavity of the evaporator is defined between the cover plate and the box body, wherein the cold supply port is formed in the rear end of the cover plate in an up-down direction, and wherein the air return port is formed in the front end of the cover plate in the up-down direction, the air return port is configured to be detachably connected to an external pipeline, and external air flows into the containing cavity via the air return port;

wherein the refrigeration system also has a centrifugal fan, which is disposed in the evaporator compartment, located behind the evaporator, and used for promoting flowing of the cooling capacity to the cold supply port, and a volute of the centrifugal fan is placed to be inclined upwards from front to rear; wherein the refrigeration system further has a heat dissipation fan; the bottom of the compressor compartment has a supporting plate, and the supporting plate comprises a first section and a second section extending forwards from a front end of the first section; the compressor, the heat dissipation fan and the condenser are successively disposed on the first section in a transverse direction, and a bottom air inlet and a bottom air outlet are formed in the second section at an interval in the transverse direction, wherein the condenser is adjacent to the bottom air inlet, and the compressor is adjacent to the bottom air outlet; the heat dissipation fan is configured to promote that ambient air in a space, between a bottom of the refrigeration module and a support surface on which the refrigeration is located, and around the bottom air inlet enters the compressor compartment from the bottom air inlet, and sequentially passes through the condenser and the compressor, and then flows from the bottom air outlet to the space so as to dissipate heat from the compressor and the condenser; wherein the refrigeration module further comprises a special-shaped plate comprising a bottom horizontal section located at a front side of the bottom of the refrigeration module, a front end of the second section being connected with a rear end of the bottom horizontal section such that the supporting plate and the bottom horizontal section jointly form a bottom wall of the refrigeration module; and a bent section, bending and extending upwards and backwards from the rear end of the bottom horizontal section to a position above the supporting plate, so as to form a top of the compressor compartment.

2. The refrigeration module according to claim 1, wherein an electrical connection port is further formed in the rear end of the cover plate in the up-down direction, the electrical connection port is configured to be detachably connected to an external pipeline having a power supply line, and the power supply line is introduced into the refrigeration module via the electrical connection port; the electrical connection port is formed in the lateral portion of the cold supply port in a transverse direction.

3. The refrigeration module according to claim 1, wherein the evaporator comprises a plurality of fins disposed in parallel and a coil pipe penetrating through the fins, an airflow channel is defined between adjacent fins, and the evaporator is transversely placed in the evaporator compartment so that the airflow channel extends in a front-rear direction.

4. A refrigerator, comprising:

one or more storage portions, a corresponding storage space being defined in each storage portion; and the refrigeration module according to claim 1; wherein the one or more storage portions and the refrigeration module are disposed separately, and the cooling capacity flows out of the refrigeration module from the cold supply port and then flows into the storage portion via the pipeline.

5. The refrigerator according to claim 4, wherein at least a part of the pipeline is a vacuum pipe;

the vacuum pipe comprises an outer pipe, an inner pipe and an end sealing connection piece, wherein the outer pipe is disposed outside the inner pipe in a sleeving mode and is disposed at an interval from the inner pipe; the end sealing connection piece is configured to be sandwiched between the outer pipe and the inner pipe to seal and fix the outer pipe and the inner pipe, and a vacuum cavity is defined among the outer pipe, the inner pipe and the end sealing connection piece; the outer pipe is made of a metal pipe fitting; the inner pipe is made of a metal pipe fitting; the end sealing connection piece is made of quartz glass.

6. The refrigeration module according to claim 1, wherein the bent section comprises a first inclined section, a second inclined section, a third inclined section and a top horizontal section, wherein the first inclined section extends upwards from the rear end of the bottom horizontal section, the second inclined section extends backwards and upwards from an upper end of the first inclined section, the third inclined section extends backwards and upwards from an upper end of the second inclined section, and the top horizontal section extends backwards from an upper end of the third inclined section to cover a position above the first section of the supporting plate.

* * * * *